US009569914B2

(12) United States Patent
Kono et al.

(10) Patent No.: US 9,569,914 B2
(45) Date of Patent: Feb. 14, 2017

(54) GAMING MACHINE WITH A PREDETERMINED NUMBER OF SYMBOLS SCROLLED FOR DISPLAY PRIOR TO WILD SYMBOL AND HAVING A PREDETERMINED BACKGROUND COLOR AND CONTROL METHOD THEREOF

(75) Inventors: Ryohei Kono, Koto-ku (JP); Yoshinari Mitani, Koto-ku (JP); Toshiaki Ohkubo, Koto-ku (JP); Shigeki Hayashi, Koto-ku (JP); Hiroki Abe, Koto-ku (JP); Takanori Sakata, Koto-ku (JP)

(73) Assignee: ARUZE GAMING AMERICA, INC., Las Vegas, NV (US)

( * ) Notice: Subject to any disclaimer, the term of this patent is extended or adjusted under 35 U.S.C. 154(b) by 1081 days.

(21) Appl. No.: 12/566,139

(22) Filed: Sep. 24, 2009

(65) Prior Publication Data

US 2010/0093424 A1 Apr. 15, 2010

Related U.S. Application Data

(60) Provisional application No. 61/105,145, filed on Oct. 14, 2008.

(51) Int. Cl.
*G07F 17/32* (2006.01)

(52) U.S. Cl.
CPC ..... *G07F 17/32* (2013.01); *G07F 17/3202* (2013.01); *G07F 17/3267* (2013.01); *G07F 17/3211* (2013.01)

(58) Field of Classification Search
CPC .. G07F 17/3211; G07F 17/32; G07F 17/3202; G07F 17/3267
USPC ..... 463/31
See application file for complete search history.

(56) References Cited

U.S. PATENT DOCUMENTS

| | | | | |
|---|---|---|---|---|
| 2004/0084844 | A1 | 5/2004 | Adams | |
| 2005/0070354 | A1* | 3/2005 | Baerlocher et al. | 463/20 |
| 2007/0015565 | A1* | 1/2007 | Chan | 463/20 |
| 2008/0108411 | A1 | 5/2008 | Jensen et al. | |
| 2008/0167125 | A1* | 7/2008 | Dias et al. | 463/31 |
| 2008/0188286 | A1* | 8/2008 | Jaffe | 463/20 |
| 2009/0069083 | A1* | 3/2009 | Okada et al. | 463/31 |
| 2009/0191943 | A1* | 7/2009 | Visser | 463/20 |

* cited by examiner

*Primary Examiner* — Werner Garner
(74) *Attorney, Agent, or Firm* — Lex IP Meister, PLLC

(57) ABSTRACT

A slot machine includes a display on which symbols are rearranged in partitioned regions arranged in a matrix pattern including a plurality of columns and rows. The display includes a plurality of display windows corresponding to the respective columns for each unit game. In each of the display windows, for each slot game, executed is video display in which a symbol array having a plurality of symbols arranged therein is scrolled in an arrangement direction of the symbols. By this video display, the symbols arranged in the partitioned regions are rearranged in the slot game. When a feature game trigger is established during the slot game, an additional "WILD" symbol is inserted into the symbol array. The symbols in each symbol array have background images, respectively. The background images of a predetermined number of consecutive symbols immediately upstream of the "WILD" symbol are displayed in a predetermined color, and the background images of the other symbols are displayed in a normal color.

6 Claims, 11 Drawing Sheets

| | COLUMN 1 | COLUMN 2 | COLUMN 3 | COLUMN 4 | COLUMN 5 |
|---|---|---|---|---|---|
| ROW 1 | q11 | q21 | q31 | q41 | q51 |
| ROW 2 | q12 | q22 | q32 | q42 | q52 |
| ROW 3 | q13 | q23 | q33 | q43 | q53 |
| ROW 4 | q14 | q24 | q34 | q44 | q54 |
| | 16a | 16b | 16c | 16d | 16e |

GAMING MACHINE WITH A PREDETERMINED NUMBER OF SYMBOLS SCROLLED FOR DISPLAY PRIOR TO WILD SYMBOL AND HAVING A PREDETERMINED BACKGROUND COLOR AND CONTROL METHOD THEREOF

CROSS REFERENCE TO RELATED APPLICATION

This application claims priority to U.S. provisional patent application Ser. No. 61/105,145 filed on Oct. 14, 2008, and which is incorporated by reference herein for all purposes.

BACKGROUND OF THE INVENTION

1. Field of the Invention

The present invention relates to a gaming machine for arranging and rearranging symbols in display windows of a display for each unit game by executing video display in a mode of scrolling and stopping symbol arrays in an arrangement direction of the symbols, the symbol arrays having a plurality of the symbols arranged in a predetermined order, and also relates to a control method thereof.

2. Description of the Related Art

US Patent Application Publication No. 2004/0084844 discloses a gaming machine for displaying, on a display, a card game in which a WILD card is dealt in a unit game. In this gaming machine, the dealt WILD card can be used as a card advantageous to a player. Generally, if combining the WILD card with other dealt cards different from the WILD card brings the winning of an award or a higher award to the player, the WILD card is used as a card necessary for the winning.

Moreover, US Patent Application Publication No. 2008/0108411 discloses a slot machine for performing, on a display, arrangement and rearrangement of symbols in a unit game by rotating and stopping reels. In this slot machine, when a WILD symbol on the reel is rearranged on the display, the WILD symbol is regarded as a symbol advantageous to a player. Generally, if combining the WILD card with other rearranged symbols different from the WILD symbol brings the winning of an award or a higher award to the player, the WILD symbol is used as a symbol necessary for the winning.

In the conventional gaming machines described above, when the WILD symbol is rearranged in the unit game, an award or a higher award is more likely to be won.

There has been desired a gaming machine having new entertainment properties compared with the conventional gaming machines as described above.

SUMMARY OF THE INVENTION

It is an object of the present invention to provide a gaming machine capable of providing new entertainment properties, in which symbols arranged in a plurality of partitioned regions arranged in a matrix pattern including a plurality of columns and rows are rearranged on a display for each unit game, and a control method thereof.

A first aspect of the present invention is a gaming machine comprising: a display configured to display a video in a mode of scrolling and stopping a variable subsequence of a sequence of symbols for a symbol rearrangement in a respective unit game, the symbols including a WILD symbol and arranged in a predetermined order in the sequence; a display control circuit configured to generate a video signal of the variable subsequence of symbols to be displayed on the display; and a controller configured to (a) drive the display control circuit to generate a video signal of the variable subsequence including one or more symbols consecutive immediately downstream the WILD symbol in a scrolling direction of the variable subsequence, the one or more symbols having a background color different from background colors of the remaining symbols of the sequence, and (b) drive the display to display the one or more symbols with the background color different from the background colors of the remaining symbols of the sequence on the basis of the video signal of the variable subsequence generated by the display control circuit when the one or more symbols are displayed on the display during the respective unit game.

A second aspect of the present invention is a gaming machine comprising: a display configured to display a video in a mode of scrolling and stopping a respective variable subsequence of sequences of symbols in respective display windows for a symbol rearrangement in the display windows in a respective unit game, the symbols of the respective sequences including a WILD symbol and arranged in a predetermined order in the respective sequences; a display control circuit configured to generate a video signal of the respective variable subsequence of symbols to be displayed in the respective display windows; and a controller configured to (a) drive the display control circuit to generate a video signal of the respective variable subsequence including one or more symbols consecutive immediately downstream the WILD symbol in a scrolling direction of the respective variable subsequence, the one or more symbols having a background color different from background colors of the remaining symbols of the respective sequences, and (b) drive the display to display the one or more symbols with the background color different from the background colors of the remaining symbols of the respective sequences on the basis of the video signal of the respective variable subsequence generated by the display control circuit when the one or more symbols are displayed in any of the display windows during the respective unit game.

A third aspect of the present invention is a gaming machine comprising: a display configured to display a video in a mode of scrolling and stopping a respective variable subsequence of sequences of symbols in respective display windows for a symbol rearrangement in the display windows in a respective unit game, the symbols of the respective sequences including a WILD symbol and arranged in a predetermined order in the respective sequences; an image data memory configured to store therein image data on the respective symbols; a palette memory configured to store therein color data on background colors of the respective symbols; frame memories configured to periodically store therein and update, for the respective variable subsequence of symbols, video image data on the respective variable subsequence to be displayed in the respective display windows, the video image data being generated by use of the image data and the color data; a video memory configured to store therein and update synthesized video image data as data on images to be displayed on the display, the synthesized video image data being obtained by superimposing the respective video image data in the frame memories; and a controller configured to (a) specify, as color data on a background color of one or more symbols consecutive immediately upstream the WILD symbol in a scrolling direction of the respective variable subsequence, color data on a predetermined color stored in the palette memory different from color data on background colors of the remaining symbols of the respective sequences, and (b) drive the display to display the one or more symbols with the predetermined color as a background color on the basis of the synthesized video image data stored in the video memory when the one or more symbols are displayed in any of the display windows during the respective unit game.

A fourth aspect of the present invention is a method for controlling a gaming machine that displays on a display a video in a mode of scrolling and stopping a variable subsequence of a sequence of symbols for a symbol rearrangement in a respective unit game, the symbols including a WILD symbol and arranged in a predetermined order in the sequence, the method comprising: driving a display control circuit to generate a video signal of the variable subsequence including one or more symbols consecutive immediately upstream the WILD symbol in a scrolling direction of the variable subsequence, the one or more symbols having a background color different from background colors of the remaining symbols of the sequence, and driving the display to display the one or more symbols with the background color different from the background colors of the remaining symbols of the sequence on the basis of the video signal of the variable subsequence generated by the display control circuit when the one or more symbols are displayed on the display during the respective unit game.

DETAILED DESCRIPTION OF THE EMBODIMENT

Figure 1A:
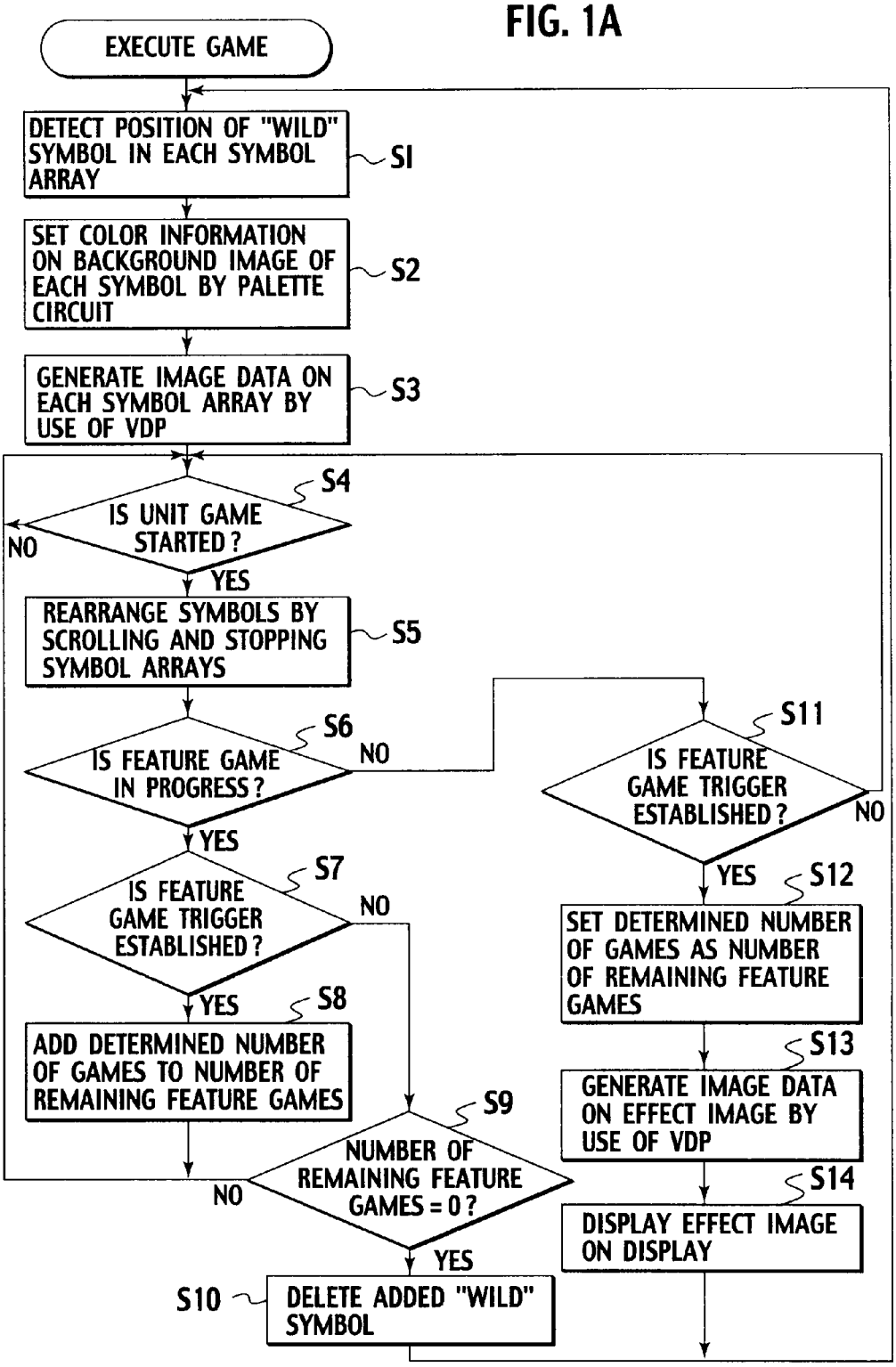
FIG. 1A is a flowchart schematically showing a procedure of processing executed by a slot machine according to an embodiment of the present invention.
Figure 1B:
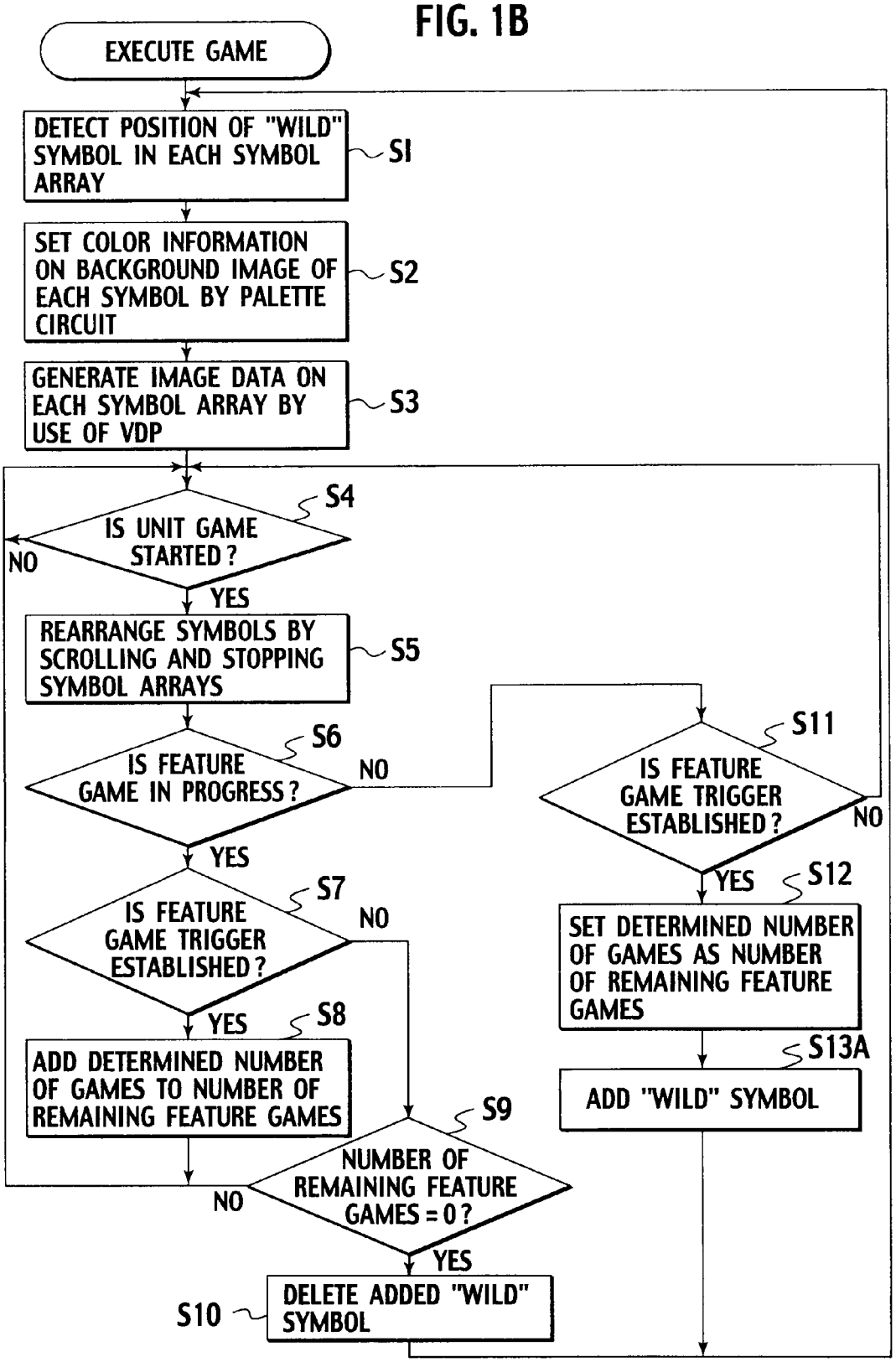
FIG. 1B is a flowchart schematically showing a procedure of processing executed by the slot machine according to the embodiment of the present invention.
Figure 2:
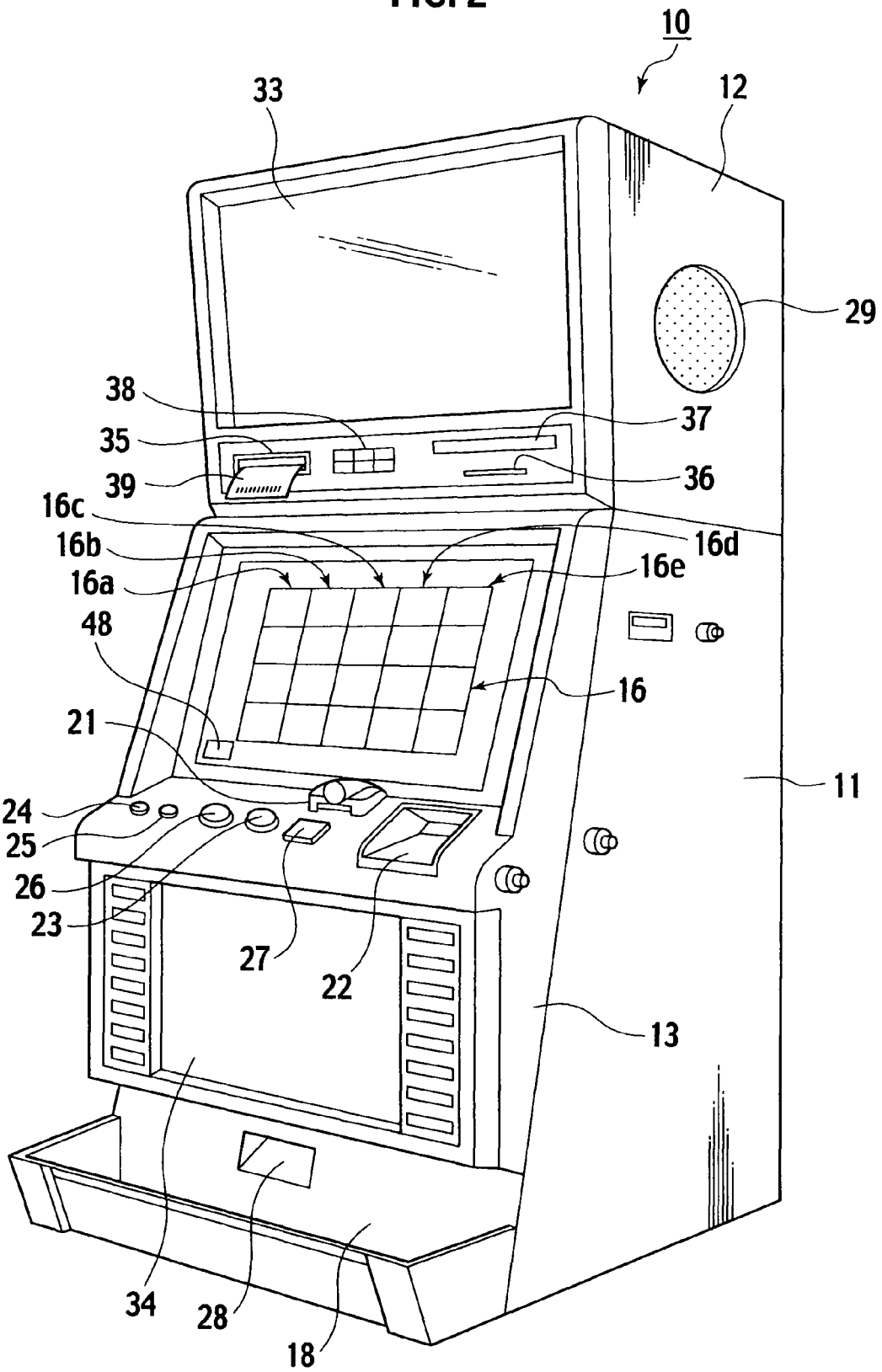
FIG. 2 is a perspective view of the slot machine according to the embodiment of the present invention.
Figures 3, 4:
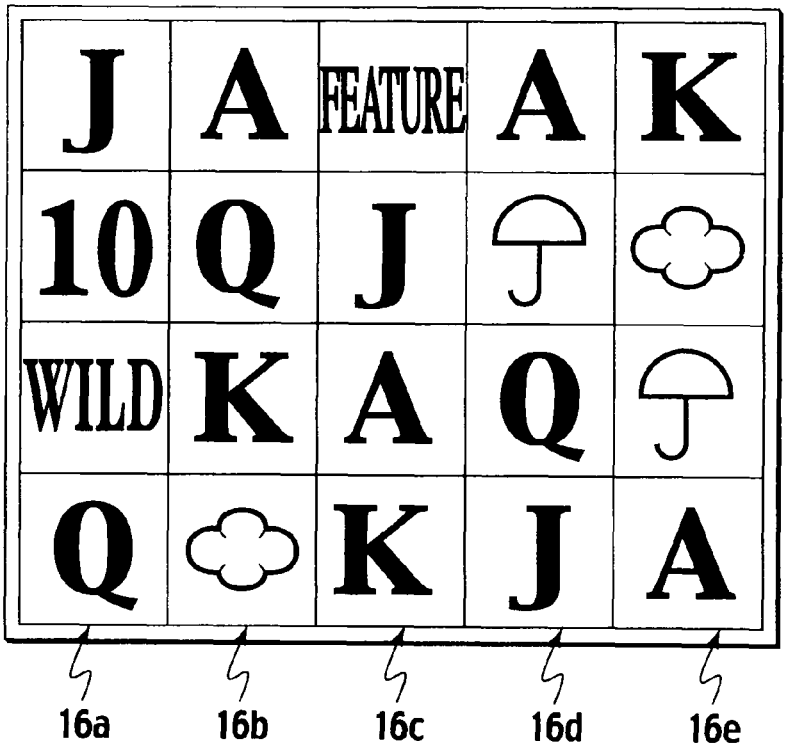
FIG. 3 is an explanatory view showing partitioned regions in a matrix pattern provided on a display on the slot machine according to the embodiment of the present invention.
FIG. 4 is an explanatory view showing a display example displayed on the display on the slot machine according to the embodiment of the present invention.
Figure 5A:
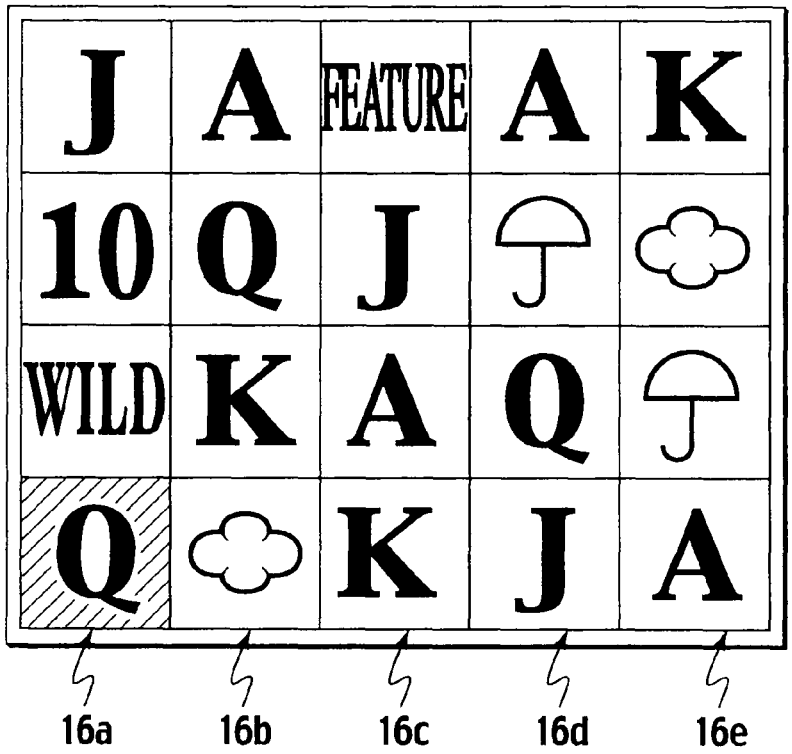
FIG. 5A is an explanatory view showing a display example displayed on the display on the slot machine according to the embodiment of the present invention.
Figure 5B:
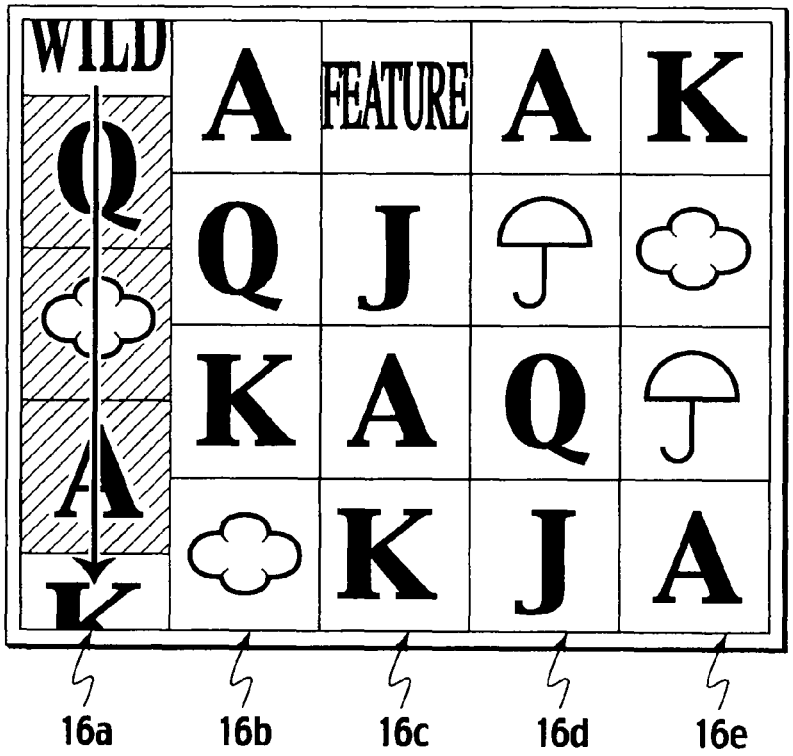
FIG. 5B is an explanatory view showing a display example displayed on the display on the slot machine according to the embodiment of the present invention.
Figure 5C:
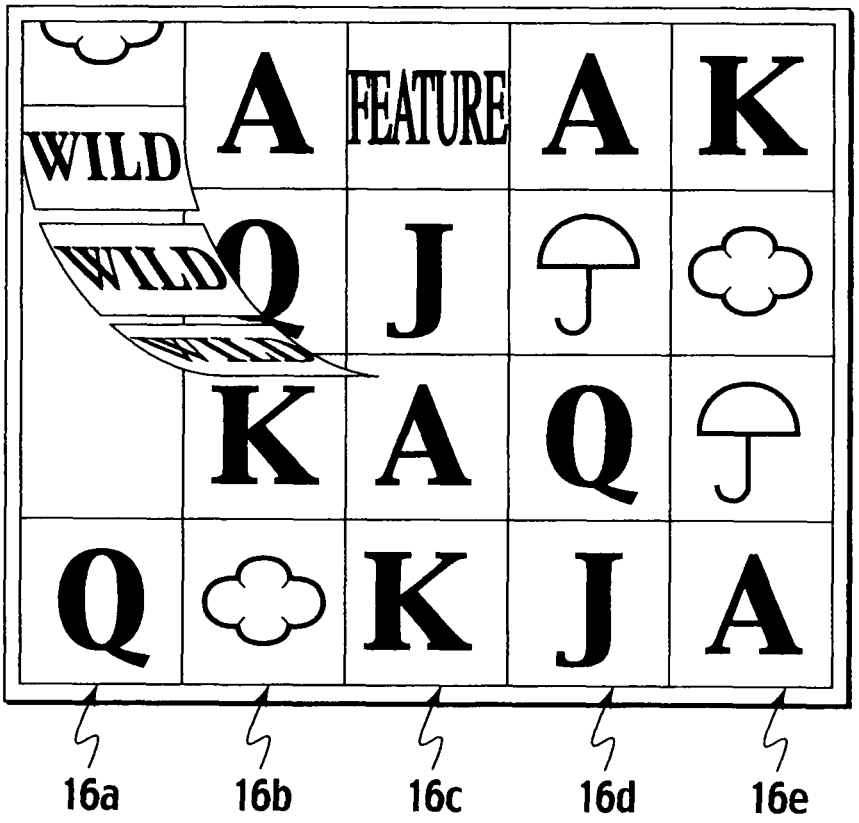
FIG. 5C is an explanatory view showing a display example displayed on the display on the slot machine according to the embodiment of the present invention.
Figure 6:
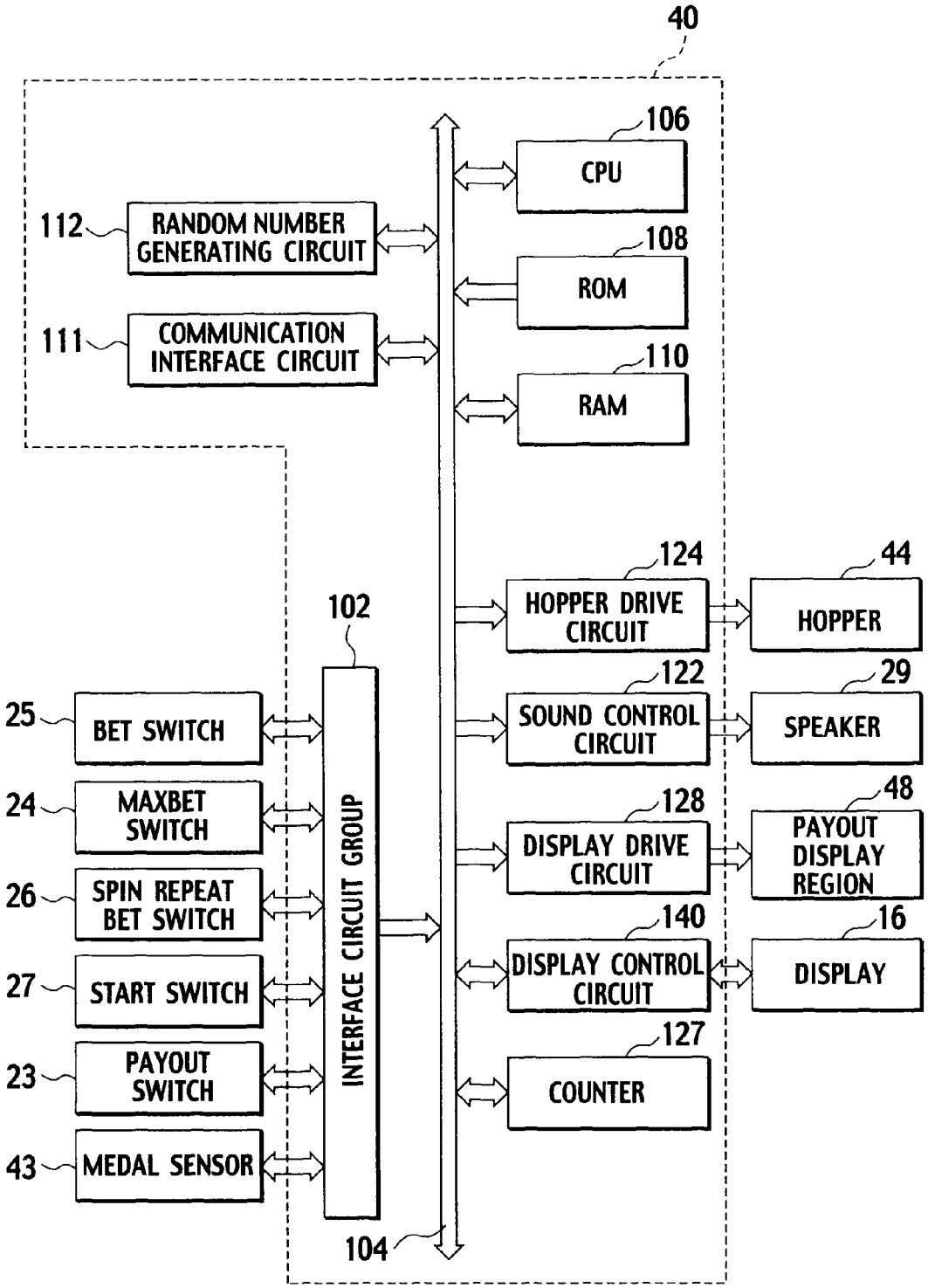
FIG. 6 is a block diagram showing a control circuit in the slot machine according to the embodiment of the present invention.

With reference to FIGS. 1A, 1B, 2, 3, 4, 5A, 5B, 5C and 6, outline will be given below of operations and a control method of a slot machine according to an embodiment of the present invention, which is an example of a gaming machine according to the present invention. FIGS. 1A and 1B are flowcharts schematically showing a procedure of processing executed by the slot machine according to the embodiment of the present invention. FIG. 2 is a perspective view of the slot machine according to the embodiment of the present invention. FIG. 3 is an explanatory view showing partitioned regions in a matrix pattern provided on a display on the slot machine according to the embodiment of the present invention. FIG. 4 is an explanatory view showing a display example displayed on the display on the slot machine according to the embodiment of the present invention. FIG. 5A is an explanatory view showing a display example displayed on the display on the slot machine according to the embodiment of the present invention. FIG. 5B is an explanatory view showing a display example displayed on the display on the slot machine according to the embodiment of the present invention. FIG. 5C is an explanatory view showing a display example displayed on the display on the slot machine according to the embodiment of the present invention. FIG. 6 is a block diagram showing a control circuit in the slot machine according to the embodiment of the present invention.

On a front surface of a cabinet 11 of a slot machine 10 shown in FIG. 2, a display 16 (equivalent to a display of the present invention) is provided. The display 16 has twenty partitioned regions q11 to q54 as shown in FIG. 3. These partitioned regions q11 to q54 are arranged in a matrix pattern including first to fifth columns and first to fourth rows.

In the slot machine 10 shown in FIG. 2, when credits are bet on a unit game and a start switch 27 is operated, the unit game is executed. Every time the unit game is played, symbols arranged in the partitioned regions q11 to q54 shown in FIG. 3 described above are rearranged. Various effect sounds related to the unit game are outputted from a speaker 29.

The symbols are rearranged for each of first to fifth display windows 16*a* to 16*e* on the display 16 shown in FIG. 2, the display windows corresponding to the first to fifth columns shown in FIG. 3, respectively. The rearrangement of the symbols in each of the display windows 16*a* to 16*e* can be executed by performing, in each of the display windows 16*a* to 16*e* on the display 16, video display in a mode of scrolling and stopping symbol arrays in an arrangement direction of the symbols, the symbol arrays having a plurality of the symbols arranged therein.

The symbol to be rearranged in each of the partitioned regions q11 to q54 shown in FIG. 3 is any one of nine kinds of symbols shown in FIG. 4, including, for example, "A (ace)," "K (king)," "Q (queen)," "J (jack)," "10," "umbrella," "cloud," "FEATURE" and "WILD." Here, a combination of symbols selected from these nine kinds of symbols is arranged in the respective symbol array in a predetermined order as a sequence of symbols. And some symbols of the respective symbol array are displayed in a mode of scrolling and stopping in each of first to fifth display windows 16*a* to 16*e* as a subsequence of the sequence of symbols.

When the symbols are rearranged in the partitioned regions q11 to q54, respectively, in the unit game, the number of credits to be provided as a payout is determined according to rules of a predetermined payout table. Thereafter, a payout for the determined number of credits is provided. Subsequently, the symbols in the respective partitioned regions q11 to q54 are rearranged as the next unit game is started.

A video signal of the symbol array, with which the video display such as scrolling and stopping is performed in each of the display windows 16*a* to 16*e* on the display 16, can be generated by a display control circuit 140 in a controller 40 shown in FIG. 6.

Figure 7A:
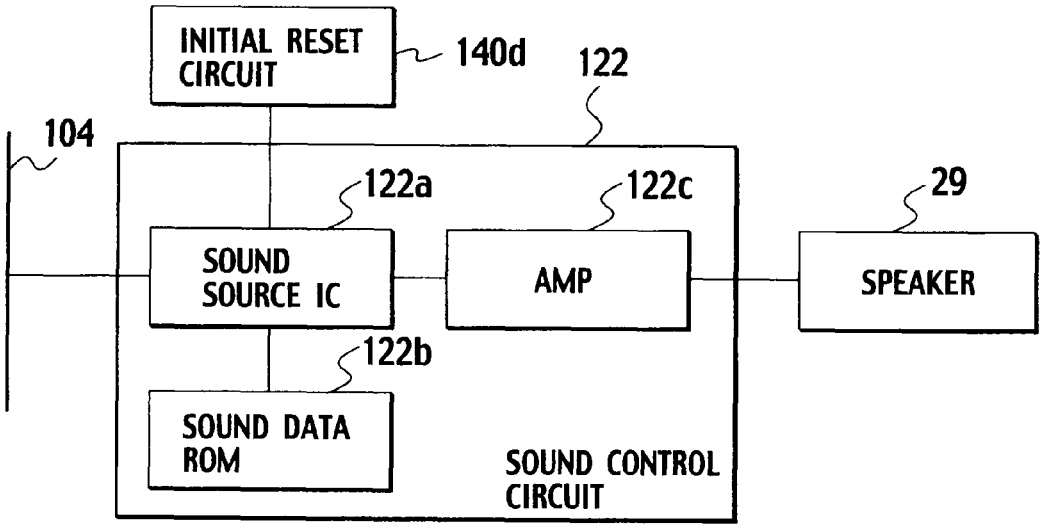
FIG. 7A is a block diagram showing a sound control circuit in the slot machine according to the embodiment of the present invention.
Figure 7B:
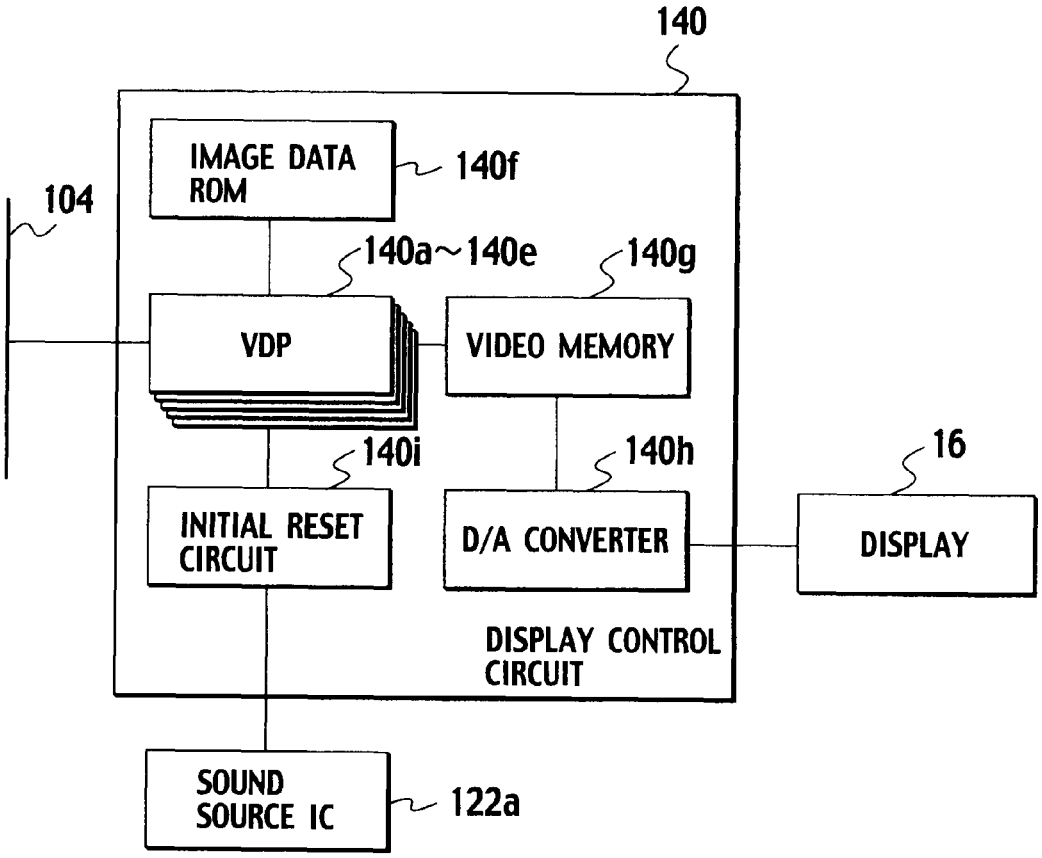
FIG. 7B is a block diagram showing a display control circuit in the slot machine according to the embodiment of the present invention.

As shown in FIG. 7B, the display control circuit 140 includes: five image data processors (hereinafter referred to as VDPs) 140*a* to 140*e* configured to generate video data on the symbol arrays corresponding to the five display windows 16*a* to 16*e*; an image data ROM 140*f* configured to store therein various image data such as the symbols in the symbol arrays; a video memory 140*g* for synthesizing the video data on each symbol array into one frame, the video data being generated by each of the VDPs 140*a* to 140*e*; a D/A converter 140*h* configured to add a synchronization signal or the like to the synthesized video data to obtain a video signal; and an initial reset circuit 140*i*.

Each of the VDPs 140*a* to 140*e* described above is connected to the image data ROM 140*f*, the video memory 140*g*, the D/A converter 140*h* and the initial reset circuit 140*i*. Moreover, each of the VDPs 140*a* to 140*e* is also connected to a CPU 106 through an I/O bus 104.

The image data ROM 140*f* separately stores therein various image data such as image data on the symbols (the nine kinds of symbols including "A (ace)," "K (king)," "Q (queen)," "J (jack)," "10," "umbrella," "cloud," "FEATURE" and "WILD") which are included in the respective symbol arrays.

Figure 7C:
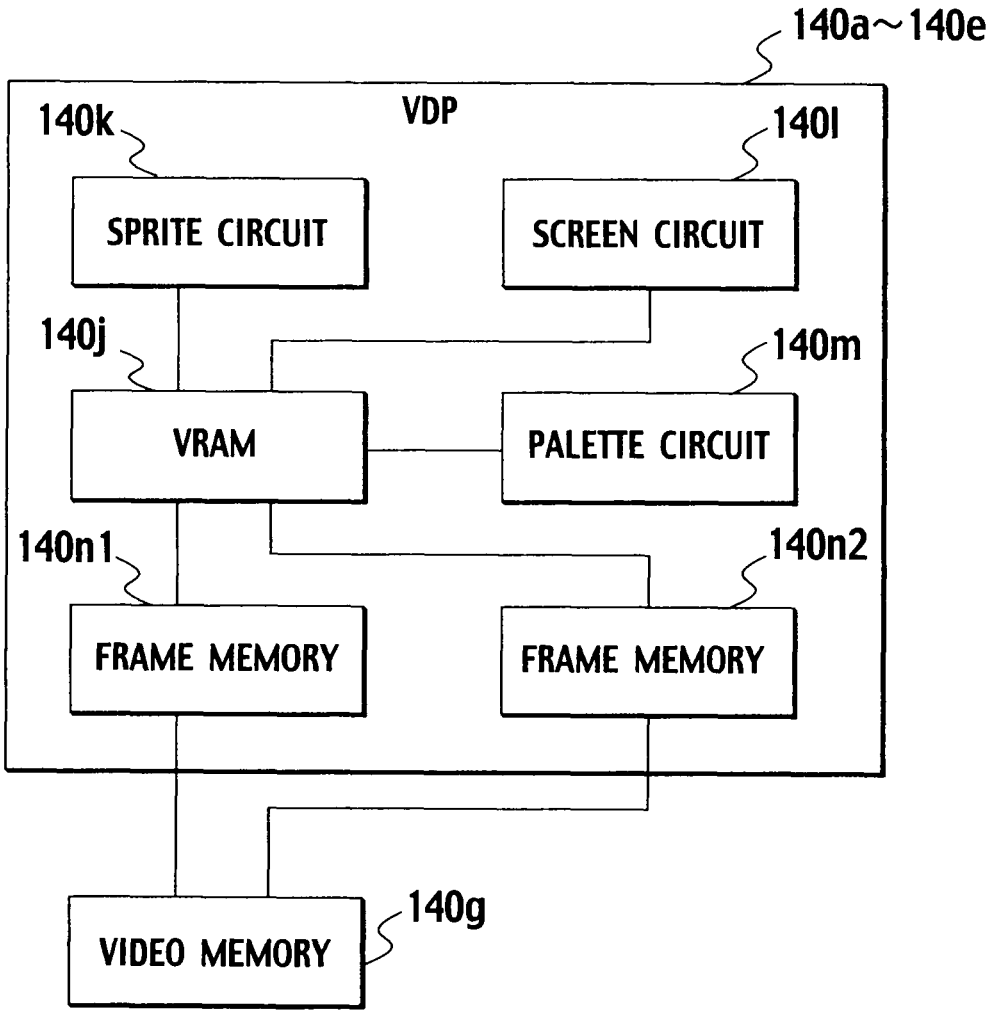
FIG. 7C is a block diagram showing the display control circuit in the slot machine according to the embodiment of the present invention.

As shown in FIG. 7C, each of the VDPs 140*a* to 140*e* includes circuits such as a VRAM 140*j*, a sprite circuit 140*k* configured to perform processing of setting contents and arrangement of the symbols in the symbol arrays, a screen circuit 140*l* configured to perform processing of setting background images of the symbol arrays, a palette circuit 140*m* configured to perform processing of setting color information on the background images of the symbol arrays, and two frame memories 140*n*1 and 140*n*2.

When image display commands are supplied to the VDPs 140*a* to 140*e* from the CPU 106, data on the background images of respective symbol arrays are drawn on the VRAMs 140*j* in the VDPs 140*a* to 140*e*, the background images being set by the screen circuits 140*l*. Moreover, based on display contents of the symbol array in each of the display windows 16*a* to 16*e*, the display contents being notified by the image display command, image data on the symbols corresponding to the display contents is read from the image data ROM 140*f* and drawn on the VRAM 140*j*.

In this event, the sprite circuit 140*k* sets a higher priority on the symbols than on the background image. Therefore, the image data on the symbol array having the symbols superimposed on the background image is drawn on the VRAM 140*j* in each of the VDPs 140*a* to 140*e*.

Moreover, the color information on the background images set by the palette circuit 140*m* indicates a normal color (for example, "white") except for the symbols "FEATURE" and "WILD" integrated with the background images. However, as described later, color information on some symbols continuous with the "WILD" symbol is changed to indicate a predetermined color (for example, "salmon pink") which is different from the normal color.

Therefore, unlike the symbols using the background image set to the normal color, the symbol using the background image having the color information set to the predetermined color has its background image displayed in the predetermined color (salmon pink), such as a "Q (queen)" symbol displayed in a first display window 16*a* shown in FIG. 5A.

Note that, in the VRAM 140*j* in each of the VDPs 140*a* to 140*e*, the image data is not drawn in the entire region for one frame. A drawing region for the image data in the VRAM 140*j* is a part of the region for one frame in the VRAM 140*j*. Specifically, the part of the region corresponds to positions and sizes of the display windows 16*a* to 16*e* on the display 16, the display windows 16*a* to 16*e* corresponding to the VDPs 140*a* to 140*e*, respectively.

Drawing data on the symbol array in each of the display windows 16*a* to 16*e* is drawn on the VRAM 140*j* in the corresponding one of the VDPs 140*a* to 140*e*, and is drawn into the frame memory 140*n*1 (the frame memory 140*n*2) in a drawing mode by use of a predetermined bit mode. Thereafter, the drawing data is transmitted to the video memory 140*g* from the frame memory 140*n*1 (the frame memory 140*n*2) which is switched to a display mode from the drawing mode after completion of the drawing. As described above, each of the frame memories 140*n*1 and 140*n*2 has a double buffer structure in which drawing and display are switched therebetween for each frame. Moreover, the image data on the respective symbol arrays drawn in the regions corresponding to the display windows 16*a* to 16*e*, respectively, in the VRAMs 140*j* in the respective VDPs 140*a* to 140*e* are synthesized in the video memory 140*g*.

The image data on the symbol arrays in the respective display windows 16*a* to 16*e*, the image data being synthesized in the video memory 140*g*, is supplied to the D/A converter 140*h* at a predetermined timing. The D/A converter 140*h* converts the image data into a video signal and supplies the video signal to the display 16 to display images of the symbol arrays in the respective display windows 16*a* to 16*e* on the display 16.

When the symbols are rearranged in the partitioned regions q11 to q54, respectively, by scrolling and stopping the symbol arrays thus displayed in the respective display windows 16*a* to 16*e* on the display 16, the number of credits to be provided as a payout is determined according to the rules of the predetermined payout table. Thereafter, a payout for the determined number of credits is provided. Subsequently, the symbols in the respective partitioned regions q11 to q54 are rearranged as the next unit game is started.

Whether or not to provide a payout or how many credits to be provided as a payout in the unit game is determined differently between the case where the slot machine 10 shown in FIG. 2 is one that executes a scatter type unit game and the case where the slot machine 10 shown in FIG. 2 is one that executes a winning combination type unit game.

In the case where the slot machine 10 shown in FIG. 2 is the one that executes the scatter type unit game, when a predetermined number or more of scatter symbols of the same kind are rearranged in the partitioned regions q11 to q54, a payout for the number of credits corresponding to the kinds of the scatter symbols and the number of the scatter symbols rearranged is generated as a payout for the unit game.

Moreover, in the case where the slot machine 10 is the one that executes the winning combination type unit game, when a winning combination is formed on a payline set in the partitioned regions q11 to q54, a payout for the number of credits corresponding to contents of the winning combination formed is generated as a payout for the unit game.

When being rearranged in any of the partitioned regions q11 to q54, each of the symbols "WILD" and "FEATURE" is handled in the same manner regardless of whether the unit game to be executed by the slot machine 10 shown in FIG. 2 is the scatter type or the winning combination type.

When a "WILD" symbol is rearranged in any of the partitioned regions q11 to q54, the "WILD" symbol can be regarded as a desired symbol among the other seven kinds of symbols except "FEATURE." Whether or not an award is won by the symbols rearranged in the partitioned regions q11 to q54 is determined after the rearranged "WILD" symbol is regarded as the desired symbol.

Moreover, for example, when "FEATURE" symbols are rearranged in the partitioned regions in the same row in three or more consecutive display windows among the first to fifth display windows 16*a* to 16*e*, a pattern of a feature game trigger is formed. Thus, a condition for starting a feature game can be considered to be established. The number of feature games to be executed in such a case can be determined, for example, by an option selection operation to be performed by a player at the start of the feature game.

In the slot machine 10 according to the embodiment of the present invention described above, as shown in FIG. 1A, first, a position of a "WILD" symbol in each of the symbol arrays corresponding to the display windows 16*a* to 16*e* on the display 16 is detected (Step S1). Thereafter, based on the detected position of the "WILD" symbol, color information on a background image of each symbol is set for each symbol array by the palette circuit 140*m* in the display control circuit 140 (Step S2).

Here, the palette circuit 140*m* sets color information on background images of a predetermined number of (for example, 3) consecutive symbols to be a predetermined color (for example, "salmon pink"). Specifically, the predetermined number of consecutive symbols are immediately upstream of the "WILD" symbol detected in Step S1 in a scrolling direction of the symbol array. The background images of the predetermined number of symbols having the color information set to the predetermined color are displayed in the predetermined color different from that of other symbols. For example, in the symbol array corresponding to the first display window 16*a* shown in FIG. 5B, background images of three symbols "Q (queen)," "cloud" and "A (ace)" arranged on the upstream of the "WILD" symbol are displayed in the predetermined color.

Moreover, the palette circuit 140*m* sets color information on background images of the other symbols to be normal "white." When a plurality of "WILD" symbols are arranged consecutively in the symbol array, color information on background images of a predetermined number of symbols continuous with the "WILD" symbol arranged on the uppermost stream side in the scrolling direction of the symbol array is set to the predetermined color.

Next, image data on each symbol array is generated by the corresponding one of the VDPs 140*a* to 140*e* (Step S3). Specifically, each of the VDPs 140*a* to 140*e* generates the image data on the corresponding symbol array by use of image data on symbols in the corresponding symbol array, the image data being stored in the image data ROM 140*f*, and color information on background images of the respective symbols, the color information being set by the palette circuit 140*m*.

Subsequently, when a unit game is started by operating the start switch 27 shown in FIG. 2 (YES in Step S4), the symbol arrays are scrolled and stopped in the first to fifth display windows 16*a* to 16*e* shown in FIG. 2. Thus, the symbols arranged in the respective partitioned regions q11 to q54 are rearranged (Step S5). Scrolling and stopping of the symbol arrays are executed by displaying images according to the image data on each symbol array in the corresponding one of the display windows 16*a* to 16*e*, the image data being generated in Step S3. The image data on the images of each symbol array displayed in the corresponding one of the display windows 16*a* to 16*e* is periodically outputted to the video memory 140*g* from the VRAM 140*j* in the corresponding one of VDPs 140*a* to 140*e* through the frame memories 140*n*1 and 140*n*2.

Next, it is determined whether or not a feature game is currently being played (Step S6). When the feature game is not currently being played (NO in Step S6), the processing moves to Step S11. On the other hand, when the feature game is currently being played (YES in Step S6), it is determined whether or not a feature game trigger is established by the symbols rearranged in the respective partitioned regions q11 to q54 when scrolling of the symbol arrays is stopped (Step S7).

When the feature game trigger is established (YES in Step S7), the number of feature games determined by a selection operation or the like performed by a player is added to the number of remaining feature games (Step S8). Thereafter, the processing moves to Step S4. On the other hand, when the feature game trigger is not established (NO in Step S7), it is determined whether or not the number of remaining feature games is set to 0 (Step S9).

When the number of remaining feature games is not set to 0 (NO in Step S9), the processing moves to Step S4. On the other hand, when the number of remaining feature games is set to 0 (YES in Step S9), an additional "WILD" symbol inserted into at least one symbol array at the start of the feature game is deleted (Step S10). The additional "WILD" symbol to be deleted here is one inserted between two symbols in a target symbol array by executing processing of Steps S13 and S14 to be described later. After the symbol is deleted, the processing moves to Step S1.

Meanwhile, when the feature game is not currently being played (NO) in Step S6, it is determined in Step S11 whether or not a pattern to establish a condition for starting a feature game is formed by the symbols rearranged in the respective partitioned regions q11 to q54 when scrolling of the symbol arrays is stopped.

When the pattern to establish the condition for starting a feature game is not formed (NO in Step S11), the processing moves to Step S4. On the other hand, when the pattern to establish the condition for starting a feature game is formed (YES in Step S11), the number of feature games determined by the selection operation or the like performed by the player is set as the number of remaining feature games (Step S12).

Next, image data on effect images associated with the start of the feature game is generated by the VDPs 140*a* to 140*e* corresponding to the display windows 16*a* to 16*e* used for displaying the effect images (Step S13). Thereafter, the effect images according to the generated image data are displayed in the corresponding display windows 16*a* to 16*e* on the display 16 (Step S14).

Each of the effect images displayed in Step S14 is, for example, one having a form in which at least one additional "WILD" symbol is inserted between two symbols "cloud" and "Q (queen)" in the display window 16*a* for a reconstruction of the symbol array as shown in FIG. 5C. In this effect image, the additional "WILD" symbol is inserted into at least one symbol array. For the display of the effect images in Step S14, the image data on the effect images generated in Step S13 is used. The image data on the effect images to be displayed on the display 16 is periodically outputted to the video memory 140*g* from the VRAM 140*j* in each of the VDPs 140*a* to 140*e* corresponding to the display windows 16*a* to 16*e* used for displaying the effect images, through the frame memories 140*n*1 and 140*n*2. After the effect images are displayed, the processing moves to Step S1.

According to the slot machine 10 and the control method thereof according to the embodiment of the present invention as described above, the player can recognize a timing at which a predetermined number of symbols having background images in a predetermined color pass through the display window by visually confirming a change in the color of the background images of the symbols passing through the display window from a normal color to the predetermined color during scrolling of the symbol array. Moreover, the player can indirectly recognize a timing at which a "WILD" symbol on the downstream of the predetermined number of symbols passes through the display window on the basis of the timing at which the predetermined number of symbols pass through the display window. Furthermore, the player recognizes that the "WILD" symbol is rearranged in the display window if the symbol array that is being scrolled is stopped at a timing close to the timing at which the color of the background images of the symbols passing through the display window is changed to the predetermined color. Therefore, the player is allowed to expect that the symbol array that is being scrolled is stopped at the timing when the symbols having the background images in the predetermined color pass through the display window. Moreover, the player's expectations for rearrangement of a specific symbol in the display window are increased. Thus, entertainment properties of the gaming machine and the control method thereof can be improved.

Note that the following configuration may also be employed. Specifically, as shown in FIG. 1B, after the number of feature games determined by the selection operation or the like performed by the player is set as the number of remaining feature games (Step S12), a "WILD" symbol is added into at least one symbol array (Step S13A) and then the processing moves to Step S1.

Moreover, the following configuration may also be employed. Specifically, after the symbols arranged in the partitioned regions q11 to q54 are rearranged in Step S5 of FIG. 1A, the processing is allowed to move to Step S4 and the processing of Steps S6 to S14 is not performed.

According to the slot machine 10 and the control method thereof according to the embodiment of the present invention having each of the configurations as described above, the player is allowed to expect that the symbol array that is being scrolled is stopped at a rearrangement timing of the "WILD" symbol. Moreover, the player's expectations for rearrangement of the "WILD" symbol in the display window are increased. Thus, the entertainment properties of the gaming machine and the control method thereof can be improved.

Next, detailed description will be given of the slot machine according to the embodiment of the present invention. As shown in FIG. 2, the slot machine 10 according to this embodiment includes the cabinet 11, a top box 12 provided on the cabinet 11 and a main door 13 provided on the front surface of the cabinet 11. On a front surface of the main door 13, the display 16 is provided. As shown in FIG. 3, the display 16 has twenty partitioned regions q11 to q54 arranged in a matrix pattern including first to fifth columns and first to fourth rows. Moreover, the display 16 includes a liquid crystal panel, which displays symbols rearranged in the partitioned regions q11 to q54 on the display 16.

Note that, in this embodiment, medals are taken as an example of game media to be used for executing games. However, the game media are not limited to the medals but may include, for example, medals, tokens, electronic money and electronic value information (credits) equivalent thereto.

Below the display 16, provided are: various operation switches used by the player to input instructions related to a game process; a coin acceptor 21 for accepting coins; and a bill validator 22 for validating whether or not bills are legitimate and for accepting the legitimate bills. Note that the bill validator 22 may be configured to be capable of reading a bar-coded ticket 39.

Moreover, near the medal insertion slot 21 and the bill validator 22, various operation switches are provided. As the operation switches, a payout switch 23, a MAXBET switch 24, a BET switch 25, a spin repeat bet switch 26 and the start switch 27 are provided.

The BET switch 25 is a switch for determining the number of credits to be bet on a slot game (unit game) to be executed on the display 16. As described later, every time the BET switch 25 is pressed, a credit for 1 medal is bet.

The spin repeat bet switch 26 is a switch for executing the slot game by betting credits again without changing the number of credits bet by use of the BET switch 25 described above in the previous game.

The start switch 27 is a switch for starting the slot game after a desired number of credits are bet. When the start switch 27 is pressed after medals are inserted into the medal insertion slot 21 or credits are bet by use of the BET switch 25, the slot game is started on the display 16.

The payout switch 23 is a switch for providing a payout of inserted medals. The medals to be provided are discharged from a medal payout opening 28 provided open in a lower front portion of the main door 13. The medals provided are accumulated in a medal tray 18.

The MAXBET switch 24 is a switch for betting, in one operation, the maximum number of credits (for example, 30 medals) that can be bet on one game.

On a lower front surface of the main door 13, a foot display 34 is provided, which displays predetermined images based on image display control data included in game software that is being executed. These images include, for example, characters of the slot machine 10, and the like.

On a front surface of the top box 12, an upper display 33 is provided. The upper display 33 includes a liquid crystal panel to display a payout table and the like.

Moreover, the speaker 29 is provided in the top box 12. Below the upper display 33, a ticket printer 35, a card reader 36, a data display 37 and a keypad 38 are provided. The ticket printer 35 prints a bar-code on a ticket and outputs the ticket as the bar-coded ticket 39, the bar-code having coded data such as the number of credits, time, date and an identification number of the slot machine 10.

The player can use the bar-coded ticket 39 to play a game with another slot machine by causing the slot machine to read the bar-coded ticket, or can exchange the bar-coded ticket 39 with bills and the like at a predetermined location in a gaming facility (for example, a cashier in a casino).

The card reader 36 allows a smart card to be inserted thereinto, reads data from the inserted smart card and writes data into the smart card. The smart card is a card carried by the player and stores therein data for identifying the player and data on a record of games played by the player.

The smart card may store therein data corresponding to coins, bills or credits. Moreover, instead of the smart card, a magnetic stripe card may be employed. The data display 37 includes a fluorescent display or the like, and displays, for example, the data read by the card reader 36 and data inputted by the player using the keypad 38.

Moreover, instead of the smart card, an RFID card capable of reading and writing data contactlessly may be used. The keypad 38 is for inputting instructions or data for ticketing and the like.

FIG. 6 is a block diagram showing a control circuit in the slot machine according to this embodiment. A controller 40 shown in FIG. 6 is a microcomputer, including an interface circuit group 102, an I/O bus 104, a CPU 106, a ROM 108, a RAM 110, a communication interface circuit 111, a random number generating circuit 112, a sound control circuit 122, a hopper drive circuit 124, a display drive circuit 128 and a display control circuit 140.

The interface circuit group 102 is connected to the I/O bus 104. The I/O bus 104 inputs and outputs a data signal or an address signal from and to the CPU 106.

The start switch 27 is connected to the interface circuit group 102. A start signal outputted from the start switch 27 is converted into a predetermined signal by the interface circuit group 102 and then transmitted to the CPU 106 through the I/O bus 104.

The BET switch 25, the MAXBET switch 24, the spin repeat bet switch 26 and the payout switch 23 are further connected to the interface circuit group 102. Each of switching signals outputted from the switches 25, 24, 26 and 23 is supplied to the interface circuit group 102, converted into a predetermined signal by the interface circuit group 102 and then transmitted to the CPU 106 through the I/O bus 104.

In addition, a medal sensor 43 is connected to the interface circuit group 102. The medal sensor 43 is a sensor for detecting medals inserted into the medal insertion slot 21 and is provided in a medal insertion part of the medal insertion slot 21. A detection signal outputted by the medal sensor 43 is supplied to the interface circuit group 102, converted into a predetermined signal by the interface circuit group 102 and then transmitted to the CPU 106 through the I/O bus 104.

The ROM 108 storing system programs therein and the RAM 110 for storing various data therein are connected to the I/O bus 104. In the RAM 110, there are provided areas and the like for managing flags and storing various information therein.

The ROM 108 stores a payout table therein. The payout table shows a correspondence relationship between a condition for generating a payout and the number of credits to be provided as a payout when the condition is satisfied. The condition for generating a payout is set by contents of symbols rearranged in the partitioned regions q11 to q54 on the display 16. The contents of the symbols rearranged to generate a payout can be set by the number of scatter symbols rearranged in a slot game or a pattern of a winning combination formed on a payline that is set in the partitioned regions q11 to q54. In the slot game of this embodiment, the CPU 106 determines whether or not to generate a payout (whether or not to provide a payout of credits) and how many credit payouts (the number of credits to be provided as a payout) are provided depending on the payout table and the symbols stopped in the partitioned regions q11 to q54, respectively.

Note that the number of credits to be provided as a payout in the slot game executed during a feature game may be a predetermined number of times (for example, 10 times) larger than the number of credits to be provided as a payout in a normal slot game.

Upon receipt of a game start operation from the start switch 27, the CPU 106 executes a game by reading a game execution program from the ROM 108. The game execution program is a program for executing a slot game on the display 16 through the display control circuit 140.

To be more specific, as the program for executing the slot game, the game execution program is configured to execute the following slot game. Specifically, symbol varying and displaying is performed in the partitioned regions q11 to q54 on the display 16 and then the symbols are stopped. When the symbols are rearranged so as to form a pattern to generate a payout, credits are provided as a payout of the payout number based on the payout table stored in the ROM 108.

The symbols are rearranged for each of first to fifth display windows 16*a* to 16*e* on the display 16 shown in FIG. 2, the display windows corresponding to the first to fifth columns shown in FIG. 3, respectively. The rearrangement of the symbols in each of the display windows 16*a* to 16*e* can be executed by performing, in each of the display windows 16*a* to 16*e* on the display 16, video display in a mode of scrolling and stopping symbol arrays in an arrangement direction of the symbols, the symbol arrays having a plurality of the symbols arranged therein.

The random number generating circuit 112, the communication interface circuit 111, the display control circuit 140, the hopper drive circuit 124, the sound control circuit 122, a counter 127 and the display drive circuit 128 are further connected to the I/O bus 104.

The communication interface circuit 111 is connected to a hall server and the like, and transmits data on a record of plays executed in the slot machine 10 to the hall server. Moreover, the communication interface circuit 111 receives various data transmitted from the hall server.

The random number generating circuit 112 generates a random number for determining whether or not to generate a winning combination or a jackpot in the slot game executed on the display 16.

The counter 127 has a function of counting jackpot bonus resources. When a wager is placed on one slot game with contents that satisfy a predetermined condition, the jackpot bonus resources counted by the counter 127 are accumulated according to a part of the wager. Note that the counter 127 can also be set inside the RAM 110.

The display drive circuit 128 performs control of displaying the number of payouts in a payout number partitioned region 48 set in the lower left area of the display 16.

The sound control circuit 122 outputs sound data to the speaker 29. Specifically, the CPU 106 reads sound data stored in the ROM 108 and transmits the sound data to the sound control circuit 122 through the I/O bus 104. The sound data stored in the ROM 108 is data for specifying the kinds of the symbols included in the symbol array. Under the control of the sound control circuit 122 that has received the sound data from the ROM 108, predetermined effect sounds corresponding to symbols expressed by the sound data received are emitted from the speaker 29.

Moreover, as shown in FIG. 7A, the sound control circuit 122 includes: a sound source IC 122*a* configured to perform control related to sounds; a sound data ROM 122*b* configured to store therein sound data on various effect sounds including BGM; an amplifier 122*c* (hereinafter referred to as an AMP) for amplifying a sound signal; and the like.

The sound source IC 122*a* is connected to the sound data ROM 122*b*, the AMP 122*c* and an initial reset circuit 140*d* configured to generate a reset signal when power is turned on. Moreover, the sound source IC 122*a* is also connected to the CPU 106 through the I/O bus 104. The sound source IC 122*a* controls sounds to be emitted from the speaker 29.

The data stored in the sound data ROM 122*b* is data on passing sounds as effect sounds when symbols in the symbol array pass through the corresponding display windows 16*a* to 16*e* in scrolling of a symbol array. Contents of the passing sound data vary depending on the kinds of the symbols.

The sound source IC 122*a* reads, from the sound data ROM 122*b*, data on symbols corresponding to the sound data that the CPU 106 reads from the ROM 108 and notifies to the sound source IC 122*a*, and converts the data into an analog signal. Thereafter, the analog signal is amplified by the AMP 122*c* and then outputted to the speaker 29. Thus, passing sounds corresponding to the symbols notified by the CPU 106 can be outputted from the speaker 29.

Note that, as the initial reset circuit 140*d*, the one provided in the display control circuit 140 shown in FIG. 7B is shared.

As shown in FIG. 6, the hopper drive circuit 124 outputs a payout signal to the hopper 44 when a payout is generated. Specifically, when a payout signal is inputted by the payout switch 23, the CPU 106 outputs a drive signal to the hopper drive circuit 124 through the I/O bus 104. Thus, the hopper 44 provides a payout of medals equivalent to the number of credits remaining at the time, which is stored in a predetermined memory region of the RAM 110.

The display control circuit 140 performs display control for executing an effect corresponding to a slot game and an outcome of the slot game on the display 16. Specifically, the CPU 106 generates an image display command signal corresponding to a state of the slot game and the outcome of the slot game, and outputs the image display command signal to the display control circuit 140 through the I/O bus 104. Upon receipt of the image display command signal outputted by the CPU 106, the display control circuit 140 generates an image signal for driving the display 16 based on the image display command, and outputs the generated image signal to the display 16. Thus, an effect screen corresponding to the slot game and the outcome thereof is displayed on the display 16.

As shown in FIG. 7B, the display control circuit 140 includes the VDPs 140*a* to 140*e* corresponding to the five display windows 16*a* to 16*e*, the image data ROM 140*f*, the video memory 140*g*, the D/A converter 140*h* and the initial reset circuit 140*i*.

Each of the VDPs 140*a* to 140*e* described above is connected to the image data ROM 140*f*, the video memory 140*g*, the D/A converter 140*h* and the initial reset circuit 140*i*. Moreover, each of the VDPs 140*a* to 140*e* is also connected to the CPU 106 through the I/O bus 104.

The image data ROM 140*f* separately stores therein various image data such as the image data on the symbols (the nine kinds of symbols including "A (ace)," "K (king)," "Q (queen)," "J (jack)," "10," "umbrella," "cloud," "FEATURE" and "WILD") which are included in the respective symbol arrays.

As shown in FIG. 7C, each of the VDPs 140*a* to 140*e* includes circuits such as the VRAM 140*j*, the sprite circuit 140*k* configured to perform processing of setting contents and arrangement of the symbols in the symbol arrays, the screen circuit 140*l* configured to perform processing of setting background images of the symbol arrays, the palette circuit 140*m* configured to perform processing of setting color information on the background images of the symbol arrays, and the two frame memories 140*n*1 and 140*n*2.

When an image display command is supplied to each of the VDPs 140*a* to 140*e* from the CPU 106, data on the background image of the corresponding symbol array is drawn on the VRAM 140*j* in each of the VDPs 140*a* to 140*e*, the background image being set by the screen circuit 140*l*. Moreover, based on display contents of the symbol array in each of the display windows 16*a* to 16*e*, the display contents being notified by the image display command, image data on the symbols corresponding to the display contents is read from the image data ROM 140*f* and drawn on the VRAM 140*j*.

In this event, the sprite circuit 140*k* sets a higher priority on the symbols than on the background image. Therefore, the image data on the symbol array having the symbols superimposed on the background image is drawn on the VRAM 140*j* in each of the VDPs 140*a* to 140*e*.

Moreover, the color information on the background images set by the palette circuit 140*m* is a normal color (for example, "white") except for the symbols "FEATURE" and "WILD" integrated with the background images. However, as described later, color information on some symbols continuous with the "WILD" symbol is changed to a predetermined color (for example, "salmon pink") which is different from the normal color.

Therefore, unlike the symbols using the background image set to the normal color, the symbol using the background image having the color information set to the predetermined color has its background image displayed in the predetermined color (salmon pink), such as the "Q (queen)" symbol displayed in the first display window 16*a* shown in FIG. 5A.

Note that, in the VRAM 140*j* in each of the VDPs 140*a* to 140*e*, the image data is not drawn in the entire region for one frame. A drawing region for the image data in the VRAM 140*j* is a part of the region for one frame in the VRAM 140*j*. Specifically, the part of the region corresponds to positions and sizes of the display windows 16*a* to 16*e* on the display 16, the display windows 16*a* to 16*e* corresponding to the VDPs 140*a* to 140*e*, respectively.

Drawing data on the symbol array in each of the display windows 16*a* to 16*e*, the data being drawn on the VRAM 140*j* in the corresponding one of the VDPs 140*a* to 140*e* is drawn into the frame memory 140*n*1 (the frame memory 140*n*2) in a drawing mode by use of a predetermined bit mode. Thereafter, the drawing data is transmitted to the video memory 140*g* from the frame memory 140*n*1 (the frame memory 140*n*2) which is switched to a display mode from the drawing mode after completion of the drawing. As described above, each of the frame memories 140*n*1 and 140*n*2 has a double buffer structure in which drawing and display are switched therebetween for each frame. Moreover, the image data on the respective symbol arrays drawn in the regions corresponding to the display windows 16*a* to 16*e*, respectively, in the VRAMs 140*j* in the respective VDPs 140*a* to 140*e* are synthesized in the video memory 140*g*.

The image data on the symbol arrays in the respective display windows 16*a* to 16*e*, the image data being synthesized in the video memory 140*g*, is supplied to the D/A converter 140*h* at a predetermined timing. The D/A converter 140*h* converts the image data into a video signal and supplies the video signal to the display 16 to display images of the symbol arrays in the respective display windows 16*a* to 16*e* on the display 16.

When the symbols are rearranged in the partitioned regions q11 to q54, respectively, by scrolling and stopping the symbol arrays thus displayed in the respective display windows 16*a* to 16*e* on the display 16, the number of credits to be provided as a payout is determined according to the rules of the predetermined payout table. Thereafter, a payout for the determined number of credits is provided. Subsequently, the symbols in the respective partitioned regions q11 to q54 are rearranged as the next unit game is started.

As shown in FIG. 6, the CPU 106 outputs, to the display control circuit 140, an image display command for displaying an image of the slot game and an effect image corresponding to the outcome of the slot game on the display 16 at a timing corresponding to a course of the slot game. Accordingly, an effect corresponding to the slot game and the outcome thereof is displayed on the display 16.

Figure 8:
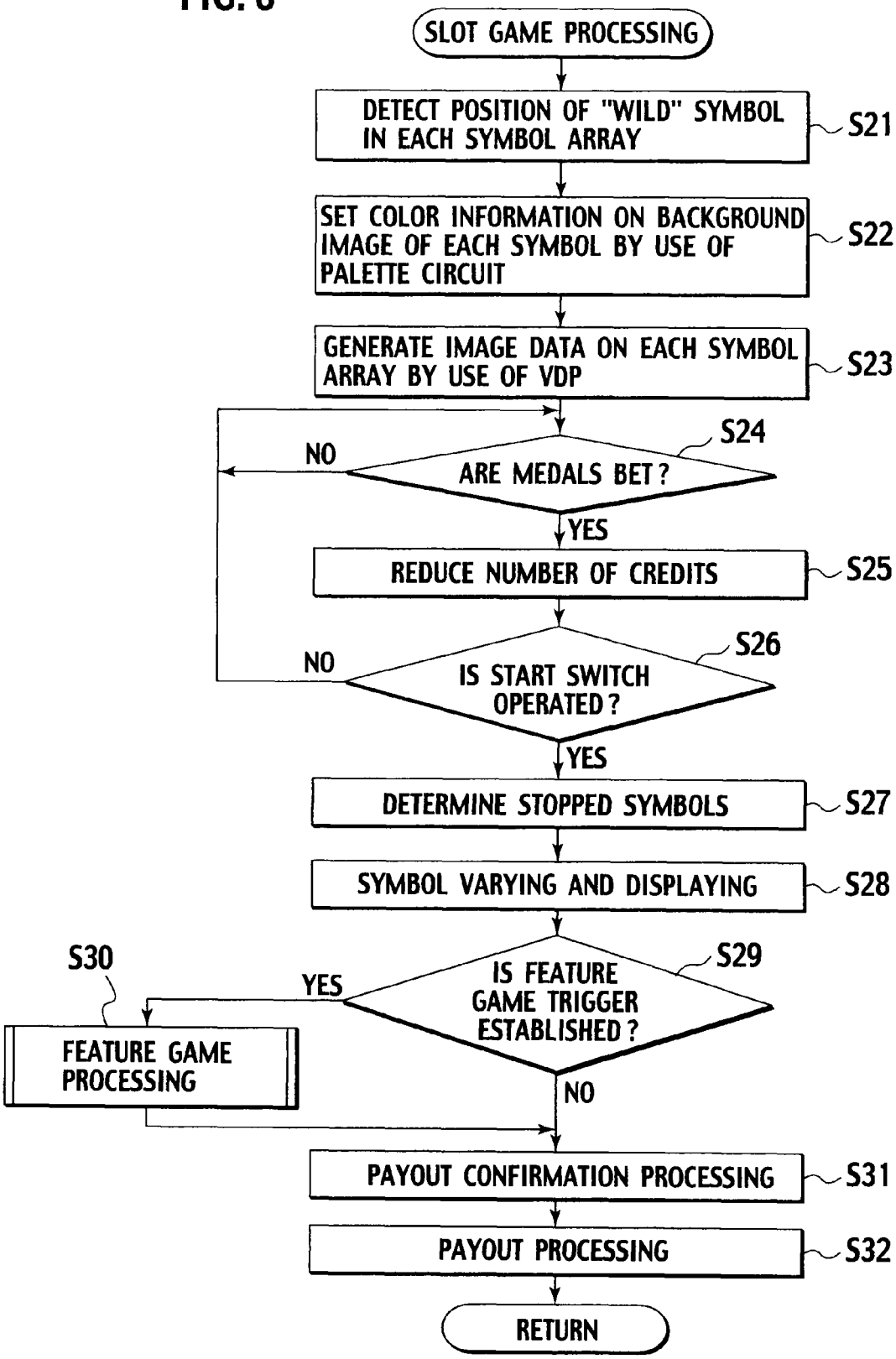
FIG. 8 is a flowchart showing a procedure of processing executed by the slot machine according to the embodiment of the present invention.

Next, with reference to a flowchart shown in FIG. 8, operations of the slot machine according to this embodiment will be described. FIG. 8 is the flowchart showing a procedure of slot game processing executed by the CPU 106 shown in FIG. 6 according to the game execution program stored in the ROM 108.

When the slot game processing shown in FIG. 8 is started, the CPU 106 first detects a position of a "WILD" symbol in each of the symbol arrays corresponding to the display windows 16*a* to 16*e* on the display 16 (Step S21). Thereafter, the CPU 106 allows the palette circuit 140*m* in the display control circuit 140 to set color information on a background image of each symbol for each symbol array on the basis of the detected position of the "WILD" symbol (Step S22).

Here, the palette circuit 140*m* sets color information on background images of a predetermined number of (for example, 3) consecutive symbols to be a predetermined color (for example, "salmon pink"). Specifically, the predetermined number of consecutive symbols are immediately upstream of the "WILD" symbol detected in Step S21 in a scrolling direction of the symbol array. Moreover, the palette circuit 140*m* sets color information on background images of the other symbols to be normal "white." When a plurality of "WILD" symbols are arranged consecutively in the symbol array, color information on background images of a predetermined number of symbols continuous with the "WILD" symbol arranged on the uppermost stream side in the scrolling direction of the symbol array is set to the predetermined color.

Next, the CPU 106 allows each of the VDPs 140*a* to 140*e* to generate image data on the corresponding symbol array (Step S23). Specifically, each of the VDPs 140*a* to 140*e* generates the image data on the corresponding symbol array by use of image data on symbols in the corresponding symbol array, the image data being stored in the image data ROM 140*f*, and color information on background images of the respective symbols, the color information being set by the palette circuit 140*m*. Thus, the image data on the symbol array as shown in the section of the first display window 16*a* shown in FIG. 5B is generated. In this symbol array, only the background images of the predetermined number of symbols immediately upstream of the "WILD" symbol are displayed in the predetermined color, and the background images of the other symbols are displayed in the normal color.

Subsequently, in Step S24, the CPU 106 determines whether or not credits are bet. In this step, the CPU 106 determines whether or not the CPU 106 has received any one of a signal outputted from the BET switch 25 when the BET switch 25 is pressed or a signal outputted from the MAXBET switch 24 when the MAXBET switch 24 is pressed. When the CPU 106 determines that no credits are bet, the processing of Step S24 is repeated.

Meanwhile, in Step S24, when the CPU determines that the credits are bet, the CPU 106 moves to Step S25 and reduces the number of credits stored in the RAM 110 according to the number of the credits bet.

Next, in Step S26, the CPU 106 determines whether or not the start switch 27 is pressed. In this step, the CPU 106 determines whether or not a signal outputted from the start switch 27 when the start switch 27 is pressed is received.

When the CPU determines that the start switch 27 is not pressed, the CPU 106 returns the processing to Step S24. Note that, in the case where the start switch 27 is not pressed (for example, the case where an instruction to finish the game is inputted without pressing the start switch 27), the CPU 106 cancels a result of reduction in the number of credits in Step S25.

Meanwhile, in Step S26, when the CPU determines that the start switch 27 is pressed, the CPU 106 moves from Step S26 to Step S27 and determines stopped symbols. In this stopped-symbol determination processing, the CPU 106 determines the symbols to be stopped and displayed (rearranged) in the respective partitioned regions q11 to q54 by executing a stopped-symbol determination program that is one of the game execution programs stored in the ROM 108.

In the stopped-symbol determination processing described above, the CPU 106 executes a random number generating program to select a random number value from among values in a range of "0 to 255" for each of the partitioned regions q11 to q54, and determines a stopped symbol for each of the partitioned regions q11 to q54 by referring to correspondence between the random number value and the symbol stored in the ROM 108.

By the stopped-symbol determination processing, each of the symbols to be rearranged in each of the partitioned regions q11 to q54 in the first to fifth columns shown in FIG. 3 is determined to be any one of nine kinds of symbols shown in FIG. 4, including "A (ace)," "K (king)," "Q (queen)," "J (jack)," "10," "umbrella," "cloud," "FEATURE" and "WILD."

Next, the CPU 106 performs processing of symbol varying and displaying in Step S28. In this processing, symbol varying and displaying is started and then stopped in the partitioned regions q11 to q54. By this processing of starting and stopping the symbol varying and displaying, the symbols are rearranged in the partitioned regions q11 to q54.

When the symbol varying and displaying is finished, the CPU 106 moves to Step S29 and determines whether or not a feature game trigger is established by the symbols rearranged in the partitioned regions q11 to q54. When the feature game trigger is established, feature game processing is executed (Step S30). In the feature game processing, executed are, for example, slot games the number of which is determined by an option selection operation to be performed by the player at the start of the feature game.

When the feature game processing in Step S30 is finished or when the feature game trigger is not established (NO) in Step S29, the CPU 106 moves to Step S31 and executes payout confirmation processing. In this processing, the CPU 106 determines whether or not the symbols rearranged in the partitioned regions q11 to q54 in the slot game executed form a pattern that wins an award.

The slot game to be determined here is basically the slot game previously executed. However, when the feature game processing in Step S17A is finished, all the slot games executed in the feature game processing are to be determined on whether or not the symbols form a pattern that wins an award.

In the case where the slot machine 10 is the one that executes the scatter type unit game, the CPU 106 determines whether or not a predetermined number or more of scatter symbols of the same kind are rearranged in the partitioned regions q11 to q54. Moreover, in the case where the slot machine 10 is the one that executes the winning combination type unit game, the CPU 106 determines whether or not a winning combination is formed on a payline set in the partitioned regions q11 to q54.

When the symbols rearranged in the partitioned regions q11 to q54 form a pattern that wins an award, the number of credits to be provided as a payout is determined according to the payout table stored in the ROM 108. The payout table used for determining the number of credits to be provided as a payout varies depending on whether the slot game in which an award is established is a normal slot game or a slot game during a feature game. Moreover, when awards are won in a plurality of slot games during the feature game, a sum of payouts to be provided is determined as the number of credits to be provided as a payout.

In Step S32, the CPU 106 executes processing of providing a payout of credits corresponding to a result of the payout content confirmation in Step S31 described above. In this payout processing, the CPU 106 adds the number of credits set in Step S31 to the number of credits stored in the RAM 110. After the payout processing, the CPU 106 returns to Step S21 described above to execute next slot game processing.

Figure 9:
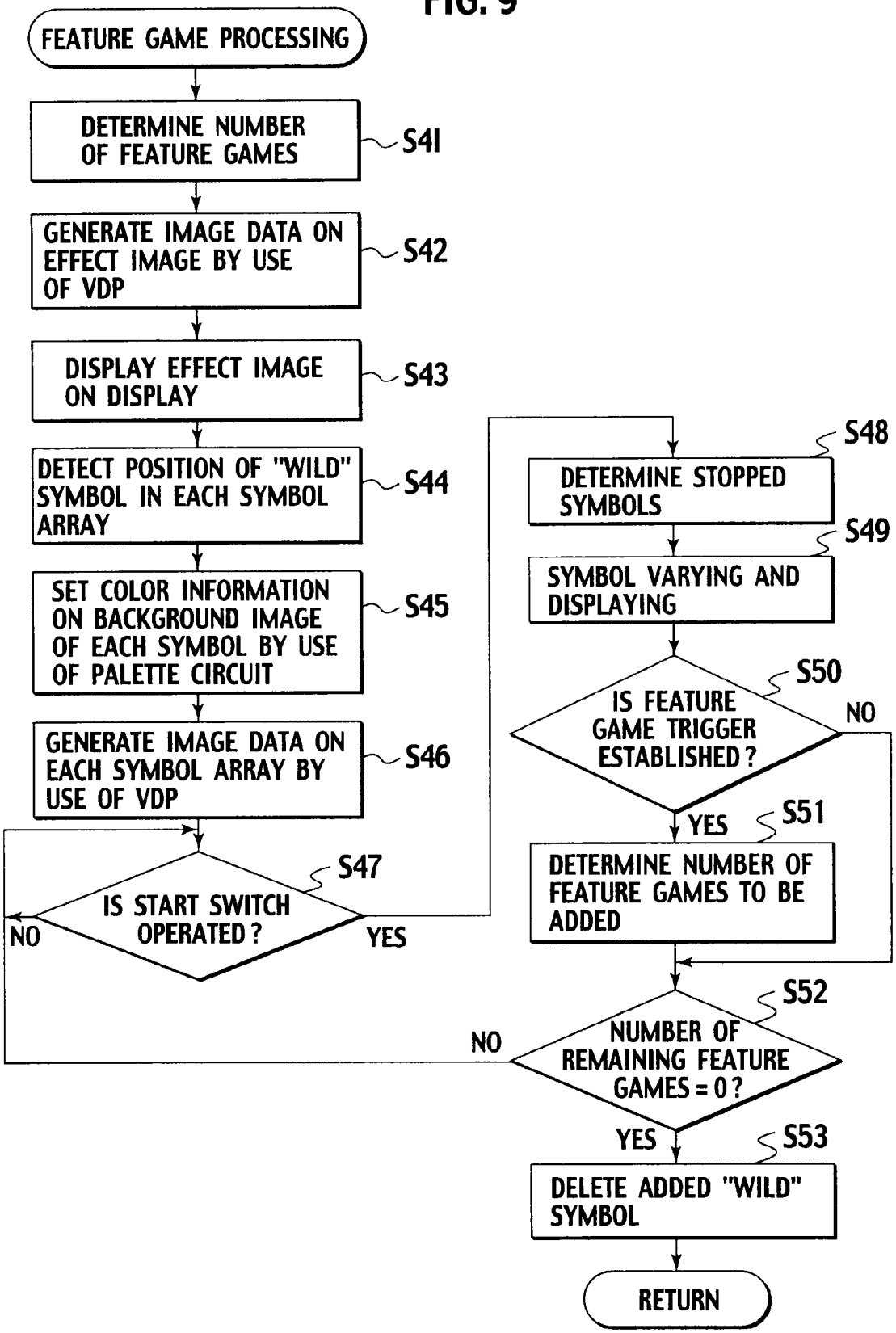
FIG. 9 is a flowchart showing a procedure of processing executed by the slot machine according to the embodiment of the present invention.

FIG. 9 is a flowchart showing a detailed procedure of the feature game processing in Step S30 shown in FIG. 8. First, in Step S41, the CPU 106 determines the number of feature games. The number of feature games may be determined, for example, based on an operation of switches by the player.

Next, the CPU 106 allows the VDPs 140*a* to 140*e* corresponding to the display windows 16*a* to 16*e* used for displaying effect images to generate image data on effect images associated with the start of the feature game (Step S42). Thereafter, the CPU 106 allows the effect images according to the generated image data to be displayed in the corresponding display windows 16*a* to 16*e* on the display 16 (Step S43).

Each of the effect images displayed in Step S43 is, for example, one having a form in which at least one additional "WILD" symbol is inserted between two symbols "cloud" and "Q (queen)" in the display window 16*a* as shown in FIG. 5C. The insertion of the additional "WILD" symbol into the symbol array may be executed only in some of the symbol arrays or may be executed in all the symbol arrays. For the display of the effect images in Step S43, the image data on the effect images generated in Step S42 is used. The image data on the effect images to be displayed on the display 16 is periodically outputted, through the frame memories 140*n*1 and 140*n*2, to the video memory 140*g* from the VRAM 140*j* in each of the VDPs 140*a* to 140*e* corresponding to the display windows 16*a* to 16*e* used for displaying the effect images. After the effect images are displayed, the CPU 106 moves to Step S44.

Next, in Step S44, the CPU 106 detects a position of a "WILD" symbol in each of the symbol arrays corresponding to the display windows 16*a* to 16*e* on the display 16. Thereafter, the CPU 106 allows the palette circuit 140*m* in the display control circuit 140 to set color information on a background image of each symbol for each symbol array on the basis of the detected position of the "WILD" symbol (Step S45).

Here, the palette circuit 140*m* sets color information on background images of a predetermined number of (for example, 3) consecutive symbols to be a predetermined color (for example, "salmon pink"). Specifically, the predetermined number of consecutive symbols are immediately upstream of the "WILD" symbol detected in Step S44 in a scrolling direction of the symbol array. Moreover, the palette circuit 140*m* sets color information on background images of the other symbols to be normal "white." Note that, when a plurality of "WILD" symbols are arranged consecutively in the symbol array because of the insertion of the additional "WILD" symbol in Steps S42 and S43, color information on background images of a predetermined number of symbols continuous with the "WILD" symbol arranged on the uppermost stream side in the scrolling direction of the symbol array is set to the predetermined color.

Next, the CPU 106 allows each of the VDPs 140*a* to 140*e* to generate image data on the corresponding symbol array (Step S46). Specifically, each of the VDPs 140*a* to 140*e* generates the image data on the corresponding symbol array by use of image data on symbols in the corresponding symbol array, the image data being stored in the image data ROM 140*f*, and color information on background images of the respective symbols, the color information being set by the palette circuit 140*m*. Thus, the image data on the symbol array as shown in the section of the first display window 16*a* shown in FIG. 5B is generated. In this symbol array, only the background images of the predetermined number of symbols immediately upstream of the "WILD" symbol are displayed in the predetermined color, and the background images of the other symbols are displayed in the normal color.

Next, in Step S47, the CPU 106 determines whether or not the start switch 27 is pressed. In this step, when the CPU 106 determines that the start switch 27 is not pressed, the CPU 106 returns the processing to Step S47. Meanwhile, when the CPU 106 determines that the start switch 27 is pressed, the CPU 106 moves from Step S47 to Step S48 and determines stopped symbols. Next, the CPU 106 performs processing of symbol varying and displaying in Step S49. The processing in Steps S47 to S49 performed by the CPU 106 is the same as that performed by the CPU 106 in Steps S26 to S28 described with reference to FIG. 8.

When the symbol varying and displaying is finished, the CPU 106 moves to Step S50 and determines whether or not a feature game trigger is established by the symbols rearranged in the partitioned regions q11 to q54. When the feature game trigger is not established (NO in Step S50), the CPU 106 moves to Step S52. On the other hand, when the feature game trigger is established (YES in Step S50), the CPU 106 determines the number of feature games to be added (Step S51). The number of feature games to be added may be determined, for example, based on an operation of switches by the player, as in the case of the determination of the number of feature games in Step S41. Thereafter, the CPU 106 moves to Step S52.

In Step S52, the CPU 106 determines whether or not the number of remaining feature games is set to 0. When the number of remaining feature games is not set to 0 (NO in Step S52), the CPU 106 moves to Step S47. On the other hand, when the number of remaining feature games is set to 0 (YES in Step S52), the additional "WILD" symbol inserted into at least one symbol array by executing the processing of Steps S42 and S43 is deleted from the symbol array (Step S53). After this processing, the CPU 106 terminates the feature game processing.

In the slot machine 10 thus configured according to this embodiment, background images of a predetermined number of (for example, 3) consecutive symbols immediately upstream of the WILD symbol among the symbols in each symbol array that is scrolled in the slot game are displayed in the predetermined color, and background images of the other symbols are displayed in the normal color. When a feature game trigger is established and an additional "WILD" symbol is inserted into at least one symbol array, background images of a predetermined number of (for example, 3) consecutive symbols immediately upstream of the additional "WILD" symbol inserted are also displayed in the predetermined color.

Therefore, during scrolling of each symbol array, when the symbol having the background image in the predetermined color passes through each of the display windows 16*a* to 16*e*, the "WILD" symbol passes through each of the display windows 16*a* to 16*e* so as to follow the symbol. Thus, the player recognizes that the "WILD" symbol is rearranged in each of the display windows 16*a* to 16*e* if the symbol array that is being scrolled is stopped at a timing immediately after the symbol having the background image in the predetermined color passes through each of the display windows 16*a* to 16*e*. Therefore, the player is allowed to expect that the symbol array that is being scrolled is stopped at the timing when the "WILD" symbol is rearranged in each of the display windows 16*a* to 16*e*. Moreover, the player's expectations for rearrangement of the "WILD" symbol in each of the display windows 16*a* to 16*e* are increased. Thus, entertainment properties of the gaming machine and the control method thereof can be improved.

Note that, in the slot machine 10 according to the embodiment described above, as to stopping of each symbol array that is being scrolled, all the symbol arrays may be stopped substantially at the same time or the symbol arrays may be stopped sequentially one by one. Instead, one or some of the symbol arrays may be stopped first, and the other one or more symbol arrays may be stopped afterwards.

Although the gaming machine and the control method thereof according to the present invention have been described above based on the illustrated embodiment, the present invention is not limited thereto. The configurations of the parts can be replaced with any configurations having the same functions.

For example, in the above embodiment, the description was given of the case where the display 16 includes the twenty partitioned regions q11 to q54 in the five columns and the four rows. However, the number of the partitioned regions to be arranged in the matrix pattern on the display is optionally determined in both of the column and row directions.

Moreover, in the above embodiment, the description was given of the slot machine 10 for playing the scatter type or winning combination type slot games. However, the present invention can also be applied, for example, to a gaming machine for playing a card game such as poker, in which whether or not an award is won or a grade of the won award is determined based on contents of card symbols "A (ace)," "K (king)," "Q (queen)," "J (jack)" and "10" rearranged on a payline.

In addition, in the detailed description above, the characteristic portions are mainly described in order to make the present invention easily understandable. The present invention is not limited to the embodiments described in the detailed description above, and can be applied to the other embodiments, and its range of application is wide. Also, the terms and the terminology used in the present specification are used only for the purpose of explaining the present invention precisely, and not used for the purpose of limiting the interpretation of the present invention. Also, for those skilled in the art, it should be easy to contemplate other configurations, systems, methods, etc., that are contained in the concept of the present invention, from the content of the invention described in the present specification. Consequently, the description of the scope of claims should be construed as containing equivalent configurations within a range of not deviating from a range of the technical ideas of the present invention. Also, the purpose of the abstract is to make it possible for the patent office, the general public organizations, and technicians and the like who belong to the present technical field and who are not thoroughly familiar with patent and law terms or specialized terms, to quickly judge the technical content and its essence of the present application by a simple search. Consequently, the abstract is not intended to limit the scope of the invention which should be evaluated by the description of the scope of claims. Also, in order to sufficiently understand the purpose of the present invention and the effects specific to the present invention, they should preferably be interpreted by sufficiently referring to the documents and the like that are already disclosed in public.

Also, the detailed description above contains the processing to be executed by a computer. The explanations and expressions in the above are described for the purpose of facilitating the most efficient understanding by those skilled in the art. In the present specification, each step used in deriving one result should be understood as a processing without a self-contradiction. Also, at each step, transmission and reception, recording, etc., of electric or magnetic signals will be carried out. In the processing at each step, such signals are expressed by bits, values, symbols, letters, terms, numbers, etc., but it should be noted that they are used simply because they are convenient for the purpose of explanation. Also, there are cases where the processing at each step is described by an expression common to the human behavior, but the processing described in the present specification is to be executed by various devices in principle. Also, the other configuration required in carrying out each step will be obvious from the above description.

What is claimed is:

1. A slot machine comprising:

a display configured to display a video in a mode of scrolling and stopping a variable subsequence of a sequence of symbols for a symbol rearrangement in a respective unit game, the symbols, each of which has a background color and a symbol image different from other symbol images, including a WILD symbol, comprising a plurality of kinds of images, and arranged in a predetermined order in the sequence;

a validator;

at least one acceptor configured to receive tangible game media;

an award payout mechanism by which the tangible game media can be paid out to a player or credited to current credits of the player as an outcome of the unit game;

a display control circuit configured to generate a video signal of the variable subsequence to be displayed on the display; and a controller, which, via the validator, identifies the tangible game media that has been added to the slot machine; which establishes a credit balance for the player based at least in part on the game media that has been added to the slot machine; and which is configured to, as a result of the player having wagered the tangible game media, (a) drive the display control circuit to generate the video signal of the variable subsequence including one or more consecutive symbols immediately downstream the WILD symbol in a scrolling direction of the variable subsequence, only the one or more consecutive symbols having a predetermined background color different from background colors of the remaining symbols of the sequence, and (b) drive the display to display the one or more consecutive symbols with the predetermined background color different from the background colors of the remaining symbols of the sequence on a basis of the video signal of the variable subsequence generated by the display control circuit such that only the one or more consecutive symbols have the predetermined background color different from the background colors of the remaining symbols of the sequence when the one or more consecutive symbols without the WILD symbol consecutive immediately downstream the WILD symbol are passed on the display during the respective unit game, wherein the controller is further configured to drive the display control circuit to generate an effect video signal of an effect image in a mode of inserting an additional WILD symbol between two of the symbols of the variable subsequence for a reconstruction of the sequence of symbols upon satisfaction of a condition for a start of a feature game by the symbols rearranged in the respective unit game, drive the display to display the effect image on the display before the start of the feature game on the basis of the effect video signal, detect positions of the one or more consecutive symbols immediately downstream the WILD symbols in the scrolling direction on the basis of the positions of the WILD symbols in the reconstructed sequence of symbols, drive the display control circuit to regenerate, on the basis of the detected positions, the effect video signal of the variable subsequence of the reconstructed sequence of symbols, the variable subsequence of the reconstructed sequence of symbols including the one or more consecutive symbols having the predetermined background color different from the background colors of the remaining symbols of the reconstructed sequence, and drive the display to display the one or more consecutive symbols with the predetermined background color different from the background colors of the remaining symbols of the reconstructed sequence on the basis of the effect video signal of the variable subsequence of the reconstructed sequence of symbols regenerated by the display control circuit when the one or more consecutive symbols are displayed on the display during the feature game, wherein the display control circuit includes:

an image data memory configured to store image data on the symbols;

a palette circuit configured to set color information on background images of the symbols;

a screen circuit configured to set the background colors of the symbols based on the color information on the background images; and an image data processor configured to generate the video signal of the variable subsequence on the symbols based on the image data and the background colors.

2. The slot machine according to claim 1, wherein the controller is further configured to drive the display control circuit to generate the video signal of the variable subsequence of the sequence of symbols including consecutive symbols more than one immediately downstream the WILD symbol in the scrolling direction of the variable subsequence, the consecutive symbols more than one immediately downstream the-WILD symbol having a background color different from the background colors of the remaining symbols of the sequence.

3. The slot machine according to claim 1, wherein the variable subsequence of the sequence of symbols includes a plurality of symbols.

4. The slot machine according to claim 1, wherein the symbols include a plurality of WILD symbols, the plurality of WILD symbols being arranged consecutively in the sequence, and the controller is further configured to drive the display control circuit to generate the video signal of the variable subsequence of the sequence of symbols including the one or more consecutive symbols immediately downstream of one of the WILD symbols arranged on the downstream side in a scrolling direction of the variable subsequence of the sequence of symbols, the one or more consecutive symbols having the predetermined background color different from the background colors of the remaining symbols of the sequence.

5. A slot machine comprising:

a display configured to display a video in a mode of scrolling and stopping a respective variable subsequence of sequences of symbols in respective display windows for a symbol rearrangement in the display windows in a respective unit game, the symbols of the respective sequences including a WILD symbol and arranged in a predetermined order in the respective sequences, each of the symbols having a background color and a symbol image different from other symbol images and comprising a plurality of kinds of images;

a validator;

at least one acceptor configured to receive tangible game media;

an award payout mechanism by which the tangible game media can be paid out to a player or credited to current credits of the player as an outcome of the unit game;

a display control circuit configured to generate a video signal of the respective variable subsequence to be displayed in the respective display windows; and a controller, which, via the validator, identifies the tangible game media that has been added to the slot machine; which establishes a credit balance for the player based at least in part on the game media that has been added to the slot machine; and which is configured to, as a result of the player having wagered the tangible game media, (a) drive the display control circuit to generate the video signal of the respective variable subsequence including one or more consecutive symbols immediately downstream the WILD symbol in a scrolling direction of the respective variable subsequence, only the one or more consecutive symbols having a predetermined background color different from background colors of the remaining symbols of the respective sequences, and (b) drive the display to display the one or more consecutive symbols with the predetermined background color different from the background colors of the remaining symbols of the respective sequences on a basis of the video signal of the respective variable subsequence generated by the display control circuit such that only the one or more consecutive symbols have the predetermined background color different from the background colors of the remaining symbols of the sequence when the one or more consecutive symbols without the WILD symbol consecutive immediately downstream the WILD symbol are passed in any of the display windows during the respective unit game, wherein the controller is further configured to drive the display control circuit to generate an effect video signal of an effect image in a mode of inserting an additional WILD symbol between two of the symbols of at least one of the variable subsequences of symbols for a reconstruction of the sequences of symbols upon satisfaction of a condition for the start of a feature game by symbols rearranged in the respective unit game, drive the display to display the effect image on the display before a start of the feature game on the basis of the effect video signal, detect positions of the one or more consecutive symbols immediately downstream the WILD symbols in the scrolling direction on the basis of the positions of the WILD symbols in the reconstructed sequences of symbols, drive the display control circuit to regenerate, on the basis of the detected positions, the video signal of a respective variable subsequence of the reconstructed sequences of symbols, the respective variable subsequence of the reconstructed sequence of symbols including the one or more consecutive symbols having the predetermined background color different from the background colors of the remaining symbols of the respective reconstructed sequences, and drive the display to display the one or more consecutive symbols with the predetermined background color different from the background colors of the remaining symbols of the respective reconstructed sequences on the basis of the video signal of the respective variable subsequence of the reconstructed sequence of symbols regenerated by the display control circuit when the one or more consecutive symbols are displayed in any of the display windows during the feature game, wherein the display control circuit includes:

an image data memory configured to store image data on the symbols; a palette circuit configured to set color information on background images of the symbols;

a screen circuit configured to set the background colors of the symbols based on the color information on the background images; and an image data processor configured to generate the video signal of the respective variable subsequence on the symbols based on the image data and the background colors.

6. A slot machine comprising:

a display configured to display a video in a mode of scrolling and stopping a respective variable subsequence of sequences of symbols in respective display windows for a symbol rearrangement in the display windows in a respective unit game, the symbols of the respective sequences including a WILD symbol and arranged in a predetermined order in the respective sequences, each of the symbols having a background color and a symbol image different from other symbol images and comprising a plurality of kinds of images;

a validator;

at least one acceptor configured to receive tangible game media;

an award payout mechanism by which the tangible game media can be paid out to a player or credited to current credits of the player as an outcome of the unit game;

an image data memory configured to store therein image data on the respective symbols;

a palette memory configured to store therein color data on background colors of the respective symbols;

a palette circuit configured to set color information on background images of the symbols based on the palette memory;

a screen circuit configured to set the background colors of the symbols based on the color information on the background images;

an image data processor configured to generate video image data on the symbols based on the image data and the background colors;

frame memories configured to periodically store therein and update, for the respective variable subsequence, the video image data on the respective variable subsequence to be displayed in the respective display windows;

a video memory configured to store therein and update synthesized video image data, the synthesized video image data being obtained by superimposing the respective video image data in the frame memories; and a controller, which, via the validator, identifies the tangible game media that has been added to the slot machine; which establishes a credit balance for the player based at least in part on the game media that has been added to the slot machine; and which is configured to, as a result of the player having wagered the tangible game media, (a) specify, as the color data on a predetermined background color of only one or more consecutive symbols immediately downstream the WILD symbol in a scrolling direction of the respective variable subsequence, color data of a predetermined color stored in the palette memory different from the color data on the background colors of the remaining symbols of the respective sequences, and (b) drive the display to display the one or more consecutive symbols with the predetermined color as the predetermined background color on a basis of the synthesized video image data stored in the video memory such that only the one or more consecutive symbols have the predetermined background color different from the background colors of the remaining symbols of the sequence when the one or more consecutive symbols without the WILD symbol consecutive immediately downstream the WILD symbol are passed in any of the display windows during the respective unit game, wherein the controller is configured to update the video image data stored in at least one of the frame memories corresponding to at least one of the sequences of symbols of the video image data for displaying in respective display windows an effect image in a mode of inserting an additional WILD symbol between two of the symbols of at least one of the variable subsequences of symbols for a reconstruction of the sequences of symbols upon satisfaction of a condition for a start of a feature game by the symbols rearranged in the respective unit game, drive the display to display an effect image on the display before a start of the feature game on the basis of the synthesized video image data stored in the video memory, detect positions of the one or more consecutive symbols immediately downstream the WILD symbols in the scrolling direction on the basis of positions of the WILD symbols in the reconstructed sequences of symbols, on the basis of the detected positions, specify the color data on the predetermined color as the color data on the predetermined background color of the one or more consecutive symbols of the reconstructed sequences of symbols and specify the color data on a color other than the predetermined color as the color data on the background colors of the remaining symbols of the respective sequences, and drive the display to display the one or more consecutive symbols with the predetermined color as a background color on the basis of the synthesized video image data stored in the video memory when the one or more consecutive symbols are displayed in any of the display windows during the feature game.

* * * * *